US010946939B1

(12) United States Patent
Montague et al.

(10) Patent No.: US 10,946,939 B1
(45) Date of Patent: Mar. 16, 2021

(54) WATERCRAFT HAVING A WATERPROOF CONTAINER AND A WATERPROOF ELECTRICAL CONNECTOR

(71) Applicant: Kai Concepts, LLC, Alameda, CA (US)

(72) Inventors: Donald Lewis Montague, Paia, HI (US); Joseph Andrew Brock, Alameda, CA (US); Tomasz Pawel Bartczak, Toronto (CA); Matthew Campbell Greaves, Oxley (AU); Alec Korver, Alameda, CA (US); Dmitri Stepanov, Alameda, CA (US)

(73) Assignee: Kai Concepts, LLC, Alameda, CA (US)

( * ) Notice: Subject to any disclaimer, the term of this patent is extended or adjusted under 35 U.S.C. 154(b) by 0 days.

(21) Appl. No.: 17/077,784

(22) Filed: Oct. 22, 2020

Related U.S. Application Data

(60) Provisional application No. 63/079,826, filed on Sep. 17, 2020, provisional application No. 63/014,014, filed on Apr. 22, 2020.

(51) Int. Cl.
*B63B 32/10* (2020.01)
*H01R 13/523* (2006.01)
(Continued)

(52) U.S. Cl.
CPC ..... *B63B 32/10* (2020.02); *B63B 1/242* (2013.01); *B63B 1/246* (2013.01); *B63B 1/248* (2013.01);
(Continued)

(58) Field of Classification Search
CPC ..... B63B 32/00; B63B 32/10; B63B 32/60; B63B 1/24; B63B 1/242; B63B 1/246;
(Continued)

(56) References Cited

U.S. PATENT DOCUMENTS 1,067,392 A 7/1913 Barr
3,405,677 A 10/1968 Smith
(Continued)

FOREIGN PATENT DOCUMENTS

AU 5012101 A 12/2002
AU 200150121 12/2002
(Continued)

OTHER PUBLICATIONS

Evolo Final Report, Apr. 23, 2009.
(Continued)

*Primary Examiner* — Ajay Vasudeva
(74) *Attorney, Agent, or Firm* — Fitch, Even, Tabin & Flannery LLP

(57) ABSTRACT

A watercraft and a waterproof electronics container are provided. The watercraft includes a flotation portion. A strut is removably affixed to a portion of the watercraft. A first connector portion is mounted to the upper end of the strut. A waterproof electronics container includes a second connector portion is disposed such that the second connector forms at least one electrically conductive pathway with the first connector portion when both are affixed to the watercraft. The waterproof electronics container is removably affixed to the said watercraft. In one aspect, the waterproof electronics container houses a power source capable of powering an electric motor that propels the watercraft.

15 Claims, 29 Drawing Sheets

(51) Int. Cl.

| | |
|---|---|
| ***H01R 13/629*** | (2006.01) |
| ***H01R 13/52*** | (2006.01) |
| ***B63B 1/24*** | (2020.01) |
| ***B63H 21/17*** | (2006.01) |
| ***B63B 32/60*** | (2020.01) |
| ***B63B 32/00*** | (2020.01) |

(52) U.S. Cl.
CPC ..... *B63B 32/00* (2020.02); *B63B 32/60* (2020.02); *B63H 21/17* (2013.01); *H01R 13/521* (2013.01); *H01R 13/5202* (2013.01); *H01R 13/523* (2013.01); *H01R 13/5219* (2013.01); *H01R 13/62938* (2013.01)

(58) Field of Classification Search
CPC .... B63B 1/248; B63H 21/17; H01R 13/5202; H01R 13/521; H01R 13/5219; H01R 13/523; H01R 13/62938
See application file for complete search history.

(56) References Cited

U.S. PATENT DOCUMENTS

| | | | |
|---|---|---|---|
| 3,593,050 | A | 7/1971 | Ware |
| 3,704,442 | A | 11/1972 | Wright |
| 3,886,884 | A | 6/1975 | Stark et al. |
| 3,902,444 | A | 9/1975 | Stark |
| 4,056,074 | A | 11/1977 | Sachs |
| 4,517,912 | A | 5/1985 | Jones |
| 5,062,378 | A | 11/1991 | Bateman |
| 5,178,089 | A | 1/1993 | Hodel |
| 5,309,859 | A | 5/1994 | Miller |
| 5,809,926 | A | 9/1998 | Kelsey |
| 5,848,922 | A | 12/1998 | Itima et al. |
| 6,095,076 | A | 8/2000 | Nesbitt |
| 6,142,840 | A | 11/2000 | Efthymiou |
| 6,178,905 | B1 | 1/2001 | Dynes et al. |
| 6,183,333 | B1 | 2/2001 | Hall |
| 6,192,817 | B1 | 2/2001 | Dec et al. |
| 6,311,631 | B1 | 11/2001 | Beecher |
| 6,371,726 | B1 | 4/2002 | Jonsson et al. |
| 6,409,560 | B1 | 6/2002 | Austin |
| 6,475,045 | B2 | 11/2002 | Schultz et al. |
| 6,568,340 | B2 | 5/2003 | Dec et al. |
| 6,578,506 | B2 | 6/2003 | Bieker |
| 6,591,776 | B2 | 7/2003 | Miyazaki |
| 6,702,634 | B2 | 3/2004 | Jung |
| 6,743,064 | B2 | 6/2004 | Gieseke |
| 6,855,016 | B1 | 2/2005 | Jansen |
| 6,902,446 | B1 | 6/2005 | Healey |
| 6,966,808 | B1 | 11/2005 | Liao |
| 7,047,901 | B2 | 5/2006 | Chen |
| 7,089,875 | B2 | 8/2006 | Kurze |
| 7,097,523 | B2 | 8/2006 | Woolley |
| 7,138,774 | B2 | 11/2006 | Negoro et al. |
| 7,143,710 | B2 | 12/2006 | Lang et al. |
| 7,166,005 | B2 | 1/2007 | Tirloni et al. |
| 7,182,036 | B2 | 2/2007 | Levine |
| 7,182,037 | B2 | 2/2007 | Otobe et al. |
| 7,226,329 | B2 | 6/2007 | Railey |
| 7,243,607 | B2 | 7/2007 | Chesney et al. |
| 7,275,493 | B1 | 10/2007 | Brass |
| 7,298,056 | B2 | 11/2007 | Gizara |
| 7,506,600 | B2 | 3/2009 | Furuya et al. |
| 7,601,041 | B2 | 10/2009 | McCarthy |
| 7,731,555 | B2 | 6/2010 | Railey |
| 7,980,191 | B2 | 7/2011 | Murphy |
| 7,993,178 | B2 | 8/2011 | Railey |
| 8,043,135 | B1 | 10/2011 | Corn |
| 8,070,544 | B2 | 12/2011 | Roman |
| 8,123,578 | B2 | 2/2012 | Mewis |
| 8,166,905 | B2 | 5/2012 | Gratsch |
| 8,290,636 | B2 | 10/2012 | Manning |
| 8,312,831 | B2 | 11/2012 | Templeman et al. |
| 8,398,446 | B2 | 3/2013 | Railey et al. |
| 8,456,310 | B2 | 6/2013 | Becker |
| 8,636,552 | B2 | 1/2014 | Braden et al. |
| 8,702,458 | B2 | 4/2014 | Preston |
| 8,851,947 | B2 | 10/2014 | Vlock et al. |
| 8,863,681 | B2 | 10/2014 | Howes et al. |
| 8,870,614 | B2 | 10/2014 | Railey |
| 8,951,079 | B2 | 2/2015 | Railey et al. |
| 9,051,038 | B1 | 6/2015 | Herber |
| 9,056,654 | B1 | 6/2015 | Fraser |
| 9,120,547 | B2 | 9/2015 | Vlock et al. |
| 9,162,741 | B2 | 10/2015 | Kohnsen |
| 9,359,044 | B2 | 6/2016 | Langelaan |
| 9,475,559 | B2 | 10/2016 | Czarnowski et al. |
| 9,573,656 | B2 | 2/2017 | Templeman |
| 9,586,659 | B2 | 3/2017 | Langelaan |
| 9,643,694 | B2 | 5/2017 | Geislinger et al. |
| 9,669,902 | B2 | 6/2017 | Geislinger |
| 9,701,372 | B2 | 7/2017 | Railey |
| 9,718,521 | B2 | 8/2017 | Derrah |
| 9,718,528 | B2 | 8/2017 | Railey et al. |
| 9,758,962 | B2 | 9/2017 | Geislinger et al. |
| 9,789,935 | B1 | 10/2017 | Aguera |
| 9,789,943 | B2 | 10/2017 | Lehmann |
| 9,835,224 | B2 | 12/2017 | Geislinger et al. |
| 9,845,138 | B2 | 12/2017 | Kohnsen |
| 10,029,775 | B2 | 7/2018 | Nikmanesh |
| 10,099,754 | B2 | 10/2018 | Tian |
| D843,303 | S | 3/2019 | Leason et al. |
| 10,227,120 | B2 | 3/2019 | Aiello |
| 10,235,870 | B2 | 3/2019 | Leason et al. |
| 10,266,239 | B2 | 4/2019 | Fry |
| 10,279,873 | B2 | 5/2019 | Logosz |
| D852,112 | S | 6/2019 | Leason et al. |
| 10,308,336 | B1 | 6/2019 | Vermeulen |
| D853,310 | S | 7/2019 | Leason et al. |
| 10,358,194 | B1 | 7/2019 | Wengreen et al. |
| D857,606 | S | 8/2019 | Dane |
| D866,872 | S | 11/2019 | Liu |
| 10,486,771 | B2 | 11/2019 | Tian |
| 10,526,057 | B2 | 1/2020 | Kohnsen |
| 10,532,797 | B2 | 1/2020 | Derrah |
| 10,597,118 | B2 | 3/2020 | Montague et al. |
| 10,597,123 | B2 | 3/2020 | Bell |
| D882,010 | S | 4/2020 | Vermillion |
| 10,618,621 | B1 | 4/2020 | Rott et al. |
| 10,625,834 | B2 | 4/2020 | MacFarlane |
| D883,177 | S | 5/2020 | Leason et al. |
| 10,647,387 | B2 | 5/2020 | Dombois |
| 10,647,392 | B2 * | 5/2020 | Trewern ..... B63B 32/60 |
| 10,668,987 | B1 | 6/2020 | Murphy |
| 10,668,994 | B2 | 6/2020 | Frank |
| 10,683,075 | B2 | 6/2020 | Schibli |
| 10,759,503 | B2 | 9/2020 | Aguera |
| 2001/0042498 | A1 | 11/2001 | Burnham |
| 2002/0072285 | A1 | 6/2002 | Jung |
| 2003/0089293 | A1 | 5/2003 | Vos |
| 2003/0167991 | A1 | 9/2003 | Namanny |
| 2004/0139905 | A1 | 7/2004 | Chen |
| 2005/0266746 | A1 | 12/2005 | Murphy |
| 2006/0249513 | A1 | 11/2006 | Duke |
| 2008/0041294 | A1 | 2/2008 | Diorio et al. |
| 2008/0168937 | A1 | 7/2008 | Ruan et al. |
| 2008/0243321 | A1 | 10/2008 | Walser et al. |
| 2008/0268730 | A1 | 10/2008 | Heesterman |
| 2011/0056423 | A1 | 3/2011 | Railey |
| 2011/0201238 | A1 | 8/2011 | Rott et al. |
| 2011/0256518 | A1 | 10/2011 | Rott |
| 2012/0000409 | A1 | 1/2012 | Railey |
| 2012/0126972 | A1 | 5/2012 | Rott et al. |
| 2013/0029547 | A1 | 1/2013 | Suzuki |
| 2013/0157526 | A1 | 6/2013 | Martin |
| 2014/0053764 | A1 | 2/2014 | Ruan et al. |
| 2015/0064995 | A1 | 3/2015 | Woods et al. |
| 2015/0001189 | A1 | 4/2015 | Kohnsen |
| 2015/0104985 | A1 | 4/2015 | Langelaan |
| 2016/0185430 | A1 | 6/2016 | Langelaan |
| 2016/0002076 | A1 | 7/2016 | Kohnsen |
| 2017/0043844 | A1 | 2/2017 | Chapman |
| 2018/0099730 | A1 | 4/2018 | Riegerbauer |

(56) References Cited

U.S. PATENT DOCUMENTS

| | | | |
|---|---|---|---|
| 2018/0118311 | A1 | 5/2018 | Kohnsen |
| 2018/0370600 | A1 | 12/2018 | Geislinger |
| 2019/0061557 | A1 | 2/2019 | Quick et al. |
| 2019/0061880 | A1 | 2/2019 | Bousquet |
| 2019/0168851 | A1 | 6/2019 | Tian |
| 2019/0233063 | A1 | 8/2019 | Geislinger |
| 2019/0233076 | A1 | 8/2019 | Aldama |
| 2019/0344862 | A1 | 11/2019 | Tian |
| 2019/0389551 | A1 | 12/2019 | Aoki et al. |
| 2020/0018969 | A1 | 1/2020 | Ou et al. |
| 2020/0047849 | A1 | 2/2020 | Claughton et al. |
| 2020/0079479 | A1* | 3/2020 | Derrah ..... B63B 32/10 |
| 2020/0102052 | A1 | 4/2020 | Geislinger et al. |
| 2020/0001400 | A1 | 5/2020 | Kohnsen |
| 2020/0172206 | A1 | 6/2020 | Terada |
| 2020/0172207 | A1 | 6/2020 | Wengreen et al. |
| 2020/0172213 | A1 | 6/2020 | Rodriguez Rondon et al. |
| 2020/0231264 | A1* | 7/2020 | Imai ..... B63B 32/60 |
| 2020/0283102 | A1 | 9/2020 | Lind et al. |

FOREIGN PATENT DOCUMENTS

| | | | |
|---|---|---|---|
| AU | 2004100571 | A4 | 8/2004 |
| AU | 2007100530 | A4 | 9/2007 |
| AU | 2007202855 | A1 | 1/2009 |
| AU | 2013100044 | A4 | 2/2013 |
| AU | 2018390893 | A1 | 7/2020 |
| BR | 102013022366 | A2 | 8/2015 |
| CN | 2675546 | Y | 2/2005 |
| CN | 2875944 | Y | 3/2007 |
| CN | 101012003 | A | 8/2007 |
| CN | 201012743 | Y | 1/2008 |
| CN | 201012744 | Y | 1/2008 |
| CN | 201023637 | Y | 2/2008 |
| CN | 201086813 | Y | 7/2008 |
| CN | 201220740 | Y | 4/2009 |
| CN | 201291996 | Y | 8/2009 |
| CN | 201300970 | Y | 9/2009 |
| CN | 201300971 | Y | 9/2009 |
| CN | 201329950 | Y | 10/2009 |
| CN | 201331716 | Y | 10/2009 |
| CN | 201347194 | Y | 11/2009 |
| CN | 201390374 | Y | 1/2010 |
| CN | 201406017 | Y | 2/2010 |
| CN | 201406019 | Y | 2/2010 |
| CN | 201406020 | Y | 2/2010 |
| CN | 201407093 | Y | 2/2010 |
| CN | 201407094 | Y | 2/2010 |
| CN | 201415754 | Y | 3/2010 |
| CN | 201437400 | U | 4/2010 |
| CN | 201447051 | U | 5/2010 |
| CN | 101734354 | A | 6/2010 |
| CN | 101734355 | A | 6/2010 |
| CN | 101734356 | A | 6/2010 |
| CN | 101746490 | A | 6/2010 |
| CN | 101870343 | A | 10/2010 |
| CN | 101870344 | A | 10/2010 |
| CN | 101870346 | A | 10/2010 |
| CN | 101871382 | A | 10/2010 |
| CN | 101927817 | A | 12/2010 |
| CN | 201914426 | U | 8/2011 |
| CN | 202264871 | U | 6/2012 |
| CN | 202574577 | U | 12/2012 |
| CN | 202574578 | U | 12/2012 |
| CN | 101875396 | B | 9/2013 |
| CN | 103373451 | A | 10/2013 |
| CN | 103373453 | A | 10/2013 |
| CN | 103419908 | A | 12/2013 |
| CN | 203381780 | U | 1/2014 |
| CN | 203567910 | U | 4/2014 |
| CN | 203593146 | U | 5/2014 |
| CN | 101879934 | B | 9/2014 |
| CN | 104229063 | A | 12/2014 |
| CN | 104229088 | A | 12/2014 |
| CN | 204056245 | U | 12/2014 |
| CN | 104260845 | A | 1/2015 |
| CN | 104260869 | A | 1/2015 |
| CN | 104295419 | A | 1/2015 |
| CN | 204124333 | U | 1/2015 |
| CN | 204197224 | U | 3/2015 |
| CN | 204197225 | U | 3/2015 |
| CN | 204197244 | U | 3/2015 |
| CN | 204197245 | U | 3/2015 |
| CN | 204197246 | U | 3/2015 |
| CN | 204197248 | U | 3/2015 |
| CN | 204197257 | U | 3/2015 |
| CN | 204197259 | U | 3/2015 |
| CN | 204197260 | U | 3/2015 |
| CN | 204197261 | U | 3/2015 |
| CN | 204200363 | U | 3/2015 |
| CN | 204200365 | U | 3/2015 |
| CN | 204200366 | U | 3/2015 |
| CN | 204200367 | U | 3/2015 |
| CN | 204200423 | U | 3/2015 |
| CN | 204200424 | U | 3/2015 |
| CN | 204200433 | U | 3/2015 |
| CN | 204200443 | U | 3/2015 |
| CN | 204436577 | U | 7/2015 |
| CN | 103661833 | B | 3/2016 |
| CN | 205131588 | U | 4/2016 |
| CN | 105691563 | A | 6/2016 |
| CN | 205418042 | U | 8/2016 |
| CN | 205469703 | U | 8/2016 |
| CN | 205469704 | U | 8/2016 |
| CN | 104309792 | B | 9/2016 |
| CN | 105947135 | A | 9/2016 |
| CN | 105966562 | A | 9/2016 |
| CN | 105966563 | A | 9/2016 |
| CN | 105966564 | A | 9/2016 |
| CN | 105966565 | A | 9/2016 |
| CN | 106005300 | A | 10/2016 |
| CN | 106054707 | A | 10/2016 |
| CN | 205632952 | U | 10/2016 |
| CN | 106081001 | A | 11/2016 |
| CN | 205675195 | U | 11/2016 |
| CN | 206054103 | U | 3/2017 |
| CN | 104228695 | B | 4/2017 |
| CN | 206087218 | U | 4/2017 |
| CN | 106846757 | A | 6/2017 |
| CN | 206297715 | U | 7/2017 |
| CN | 206317993 | U | 7/2017 |
| CN | 206446772 | U | 8/2017 |
| CN | 206466156 | U | 9/2017 |
| CN | 206466161 | U | 9/2017 |
| CN | 206466166 | U | 9/2017 |
| CN | 206466174 | U | 9/2017 |
| CN | 206466180 | U | 9/2017 |
| CN | 206466191 | U | 9/2017 |
| CN | 206471439 | U | 9/2017 |
| CN | 206471884 | U | 9/2017 |
| CN | 206606355 | U | 11/2017 |
| CN | 105923116 | B | 1/2018 |
| CN | 107628209 | A | 1/2018 |
| CN | 206914584 | U | 1/2018 |
| CN | 206984297 | U | 2/2018 |
| CN | 207010363 | U | 2/2018 |
| CN | 107776839 | A | 3/2018 |
| CN | 207129115 | U | 3/2018 |
| CN | 107953977 | A | 4/2018 |
| CN | 207257921 | U | 4/2018 |
| CN | 207389479 | U | 5/2018 |
| CN | 207389513 | U | 5/2018 |
| CN | 108189978 | A | 6/2018 |
| CN | 207450184 | U | 6/2018 |
| CN | 207496901 | U | 6/2018 |
| CN | 207496902 | U | 6/2018 |
| CN | 207510694 | U | 6/2018 |
| CN | 207550443 | U | 6/2018 |
| CN | 207550444 | U | 6/2018 |
| CN | 207670628 | U | 7/2018 |
| CN | 108357650 | A | 8/2018 |
| CN | 207683736 | U | 8/2018 |
| CN | 207683737 | U | 8/2018 |
| CN | 104260846 | B | 9/2018 |

(56) References Cited

FOREIGN PATENT DOCUMENTS

| | | | | |
|---|---|---|---|---|
| CN | 108482604 | A | 9/2018 | |
| CN | 207851575 | U | 9/2018 | |
| CN | 109263823 | A | 1/2019 | |
| CN | 109334890 | A | 2/2019 | |
| CN | 107215436 | B | 3/2019 | |
| CN | 208715417 | U | 4/2019 | |
| CN | 208715431 | U | 4/2019 | |
| CN | 208715437 | U | 4/2019 | |
| CN | 208715455 | U | 4/2019 | |
| CN | 208760858 | U | 4/2019 | |
| CN | 208760859 | U | 4/2019 | |
| CN | 208760860 | U | 4/2019 | |
| CN | 208760861 | U | 4/2019 | |
| CN | 208760862 | U | 4/2019 | |
| CN | 208789898 | U | 4/2019 | |
| CN | 208855842 | U | 5/2019 | |
| CN | 209000208 | U | 6/2019 | |
| CN | 110039578 | A | 7/2019 | |
| CN | 110085788 | A | 8/2019 | |
| CN | 110171092 | A | 8/2019 | |
| CN | 110182331 | A | 8/2019 | |
| CN | 209253549 | U | 8/2019 | |
| CN | 209258326 | U | 8/2019 | |
| CN | 209258351 | U | 8/2019 | |
| CN | 209258352 | U | 8/2019 | |
| CN | 107128454 | B | 9/2019 | |
| CN | 107933845 | B | 9/2019 | |
| CN | 209366402 | U | 9/2019 | |
| CN | 209366403 | U | 9/2019 | |
| CN | 209366404 | U | 9/2019 | |
| CN | 209366405 | U | 9/2019 | |
| CN | 209366406 | U | 9/2019 | |
| CN | 209366407 | U | 9/2019 | |
| CN | 209366408 | U | 9/2019 | |
| CN | 209441573 | U | 9/2019 | |
| CN | 110362080 | A | 10/2019 | |
| CN | 110562408 | A | 12/2019 | |
| CN | 209766523 | U | 12/2019 | |
| CN | 108407991 | B | 1/2020 | |
| CN | 110683005 | A | 1/2020 | |
| CN | 209921564 | U | 1/2020 | |
| CN | 209921565 | U | 1/2020 | |
| CN | 209938884 | U | 1/2020 | |
| CN | 110816758 | A | 2/2020 | |
| CN | 110844006 | A | 2/2020 | |
| CN | 210068712 | U | 2/2020 | |
| CN | 110911888 | A | 3/2020 | |
| CN | 110901869 | B | 6/2020 | |
| DE | 102014005314 | A1 | 10/2015 | |
| DE | 202017103703 | U1 | 7/2017 | |
| DE | 202017107819 | U1 | 1/2018 | |
| DE | 202017107820 | U1 | 1/2018 | |
| DE | 202017107821 | U1 | 1/2018 | |
| DE | 202017107824 | U1 | 1/2018 | |
| DE | 202017107826 | U1 | 1/2018 | |
| DE | 102017130946 | A1 | 6/2019 | |
| DE | 102017130949 | A1 | 6/2019 | |
| DE | 102017130955 | A1 | 6/2019 | |
| DE | 102017130959 | A1 | 6/2019 | |
| DE | 102017130963 | A1 | 6/2019 | |
| DE | 102017130966 | A1 | 6/2019 | |
| DE | 102018100696 | A1 | 6/2019 | |
| DE | 102018129501 | A1 * | 9/2019 | ..... B63B 1/283 |
| EP | 3041735 | A1 | 7/2016 | |
| EP | 3526112 | A1 | 8/2019 | |
| EP | 3526113 | A1 | 8/2019 | |
| EP | 3529142 | A1 | 8/2019 | |
| EP | 3529143 | A1 | 8/2019 | |
| EP | 3277574 | B1 | 11/2019 | |
| ES | 1153639 | Y | 7/2016 | |
| FR | 3078680 | B1 | 5/2020 | |
| GB | 2580022 | A | 7/2020 | |
| HK | 1250973 | A1 | 1/2019 | |
| IN | 200701396 | I2 | 7/2008 | |
| JP | 5221737 | B2 | 6/2013 | |
| JP | 5791376 | B2 | 10/2015 | |
| KR | 100572804 | B1 | 4/2006 | |
| KR | 101024595 | B1 | 3/2011 | |
| KR | 101491661 | B1 | 2/2015 | |
| KR | 2017-0090702 | A | 8/2017 | |
| KR | 101978043 | B1 | 8/2019 | |
| KR | 102050718 | B1 | 1/2020 | |
| KR | 102095292 | B1 | 3/2020 | |
| KR | 102095294 | B1 | 3/2020 | |
| NO | 20181547 | A1 | 6/2020 | |
| PL | 3277574 | T3 | 6/2020 | |
| TW | M257328 | U | 2/2005 | |
| TW | M308901 | U | 4/2007 | |
| TW | 200848320 | A | 12/2008 | |
| TW | 201000361 | A | 1/2010 | |
| TW | I334793 | B | 12/2010 | |
| TW | M461592 | U | 9/2013 | |
| TW | I605324 | B | 11/2017 | |
| TW | M552465 | U | 12/2017 | |
| WO | 2002092420 | A1 | 11/2002 | |
| WO | 2005058685 | A1 | 6/2005 | |
| WO | 2006014085 | A1 | 2/2006 | |
| WO | 2006042359 | A1 | 4/2006 | |
| WO | 2007072185 | A2 | 6/2007 | |
| WO | 2009144400 | A2 | 12/2009 | |
| WO | 2011047431 | A1 | 4/2011 | |
| WO | 2012013770 | A2 | 2/2012 | |
| WO | 2013026714 | A1 | 2/2013 | |
| WO | 2015039970 | A1 | 3/2015 | |
| WO | 2016003121 | A1 | 1/2016 | |
| WO | 2017069322 | A1 | 4/2017 | |
| WO | 2017153338 | A1 | 9/2017 | |
| WO | 2017221233 | A1 | 12/2017 | |
| WO | 2018149044 | A1 | 8/2018 | |
| WO | 2018234969 | A1 | 12/2018 | |
| WO | 2019072196 | A1 | 4/2019 | |
| WO | 2019073126 | A1 | 4/2019 | |
| WO | 2019122087 | A1 | 6/2019 | |
| WO | 2019122091 | A1 | 6/2019 | |
| WO | 2019122098 | A1 | 6/2019 | |
| WO | 2019122176 | A1 | 6/2019 | |
| WO | 2019122185 | A1 | 6/2019 | |
| WO | 2019122225 | A1 | 6/2019 | |
| WO | 2019122321 | A1 | 6/2019 | |
| WO | 2019129687 | A1 | 7/2019 | |
| WO | 2019141799 | A1 | 7/2019 | |
| WO | 2019143276 | A1 | 7/2019 | |
| WO | WO-2019129687 | A1 * | 7/2019 | ..... B63H 11/08 |
| WO | 2019183668 | A1 | 10/2019 | |
| WO | 2019203135 | A1 | 10/2019 | |
| WO | 2019222119 | A1 | 11/2019 | |
| WO | 2020042299 | A1 | 3/2020 | |
| WO | 2020042300 | A1 | 3/2020 | |
| WO | 2020042301 | A1 | 3/2020 | |
| WO | 2020042302 | A1 | 3/2020 | |
| WO | 2020056822 | A1 | 3/2020 | |
| WO | 2020056823 | A1 | 3/2020 | |
| WO | 2020107665 | A1 | 6/2020 | |
| WO | 2020113768 | A1 | 6/2020 | |
| WO | 2020176033 | A1 | 9/2020 | |

OTHER PUBLICATIONS

JetSurfing Nation jet boards & efoils, "Awake RÄVIK Premium Electric Surfboard—unboxing and review Part 1," https://www.youtube.com/watch?v=i3P9NWw4fpg, Oct. 1, 2019.

7M Engineering, "Assembly1," https://vimeo.com/361237245, Sep. 20, 2019.

Scrapheaper, "Trampofoil—the *originals* from Sweden," https://www.youtube.com/watch?v=QQvYogFP9mw&feature=youtu.be, Aug. 15, 2010.

Ray Vellinga, "Hydrofoil—Thrilling Swedish Invention," https://www.youtube.com/watch?v=kIAggNlir9A&feature=youtu.be, Oct. 27, 2011.

* cited by examiner

WATERCRAFT HAVING A WATERPROOF CONTAINER AND A WATERPROOF ELECTRICAL CONNECTOR

RELATED APPLICATIONS

This application claims the benefit of U.S. Provisional Application No. 63/079,826 filed Sep. 17, 2020, which is incorporated by reference in its entirety herein. This application also claims the benefit of U.S. Provisional Application No. 63/077,714 filed Apr. 22, 2020.

FIELD

This disclosure relates to watercraft having electrical plug connectors and, in particular, to harsh environment, water-resistant electrical plug connectors.

BACKGROUND

Electrical equipment including batteries, navigational equipment, radios, lights, and the like are often included on watercraft devices, for example, boats. Due to the wet environment in which watercraft operate, electronics often must be sealed or housed within watertight compartments. Some watercraft may operate in harsh environments, such as shore-break, where typical waterproofing methods are prone to fail. A problem exists in that when a portion of the electrical equipment of the watercraft needs to be removed or replaced, the electrical equipment of the watercraft may be exposed to fluids and other debris such. As an example, a battery may need to be removed from the watercraft to be serviced or charged. Thus, there exists a need for an apparatus that enables an electrical component to be repeatedly removed or disconnected and reconnected from another electrical component in "the field" (e.g., when the watercraft remains in a wet or otherwise harsh environment) without damaging either of the electrical components or the entire watercraft as the electrical components are being disconnected or reconnected or when the electrical components remain fully disconnected from one another.

SUMMARY

Generally speaking and pursuant to these various embodiments, a watercraft is provided comprising a flotation portion having a top surface and a bottom surface. A strut having an upper end is removably affixed to a portion of the watercraft. The strut has a lower end extending away from the bottom surface of the flotation portion. A propulsion unit is disposed on the strut. A first connector portion mounted to the upper end of the strut. The watercraft further comprises a waterproof electronics container housing a power source, and the waterproof electronics container is removably affixed to the said watercraft. The waterproof electronics container is mechanically coupled to the strut such that the container and the strut clamp a portion of the flotation portion therebetween. A second connector portion is disposed on the waterproof electronics container such that the second connector forms at least one electrically conductive pathway with the first connector portion when both are affixed to the watercraft. The electrically conductive pathway may carry electrical power to the propulsion unit. The electrically conductive pathway may also or alternatively carry communication signals between a transceiver in the waterproof electronics container and a transceiver mounted in the propulsion unit. In some examples, the watercraft further comprises a hydrofoil removably attached at a lower end of the strut.

In yet another described example, the waterproof electronics container is mechanically coupled to the strut by a mechanism incorporated into the carrying handle for the waterproof electronics container. The carrying handle advantageously allows the user to easily carry the container when removed from the watercraft, and also as a locking mechanism.

In another described example, one or both of the first connector portion and the second connector portion have replaceable conductor elements. These replaceable elements advantageously allow the connectors to be rebuilt if elements of the connectors wear out after repeated insertion and removal of the container. In certain examples, the container includes at least one seal encircling the second connector portion and disposed in an opening within the waterproof electronics container such that the second connector forms a portion of the waterproof electronics container. With this feature, the waterproof electronics container remains waterproof during the process of replacing the conductor elements.

In another described example, the watercraft includes at least one cavity disposed in the flotation portion, the at least one cavity configured to receive the waterproof electronics container. In certain examples, the at least one cavity is formed on the top surface of the flotation portion. The at least one cavity may further be configured such that, when the waterproof electronics container is disposed in the at least one cavity, a top surface of the waterproof electronics container is substantially coplanar with the top surface of the flotation portion. The top surface of the waterproof electronics container in these examples is configured to support a rider on the watercraft when the waterproof electronics container is disposed in the at least one cavity.

In certain examples, the at least one cavity is formed on a rear surface of the flotation portion, i.e., located at the aft end of the watercraft. The at least one cavity may further be configured such that, when the waterproof electronics container is disposed in the at least one cavity, a rear surface of the waterproof electronics container is substantially coplanar with the rear surface of the flotation portion.

In certain examples, the at least one cavity is formed on the bottom surface of the flotation portion. The at least one cavity may further be configured such that, when the waterproof electronics container is disposed in the at least one cavity, a bottom surface of the waterproof electronics container is substantially coplanar with the bottom surface of the flotation portion.

In certain examples, the watercraft includes at least one latching pin disposed on the upper end of the strut. A carrying handle pivotally coupled to the waterproof electronics container has at least one arcuate slot. In these examples, the waterproof electronics container is mechanically coupled to the strut by engagement of the at least one latching pin with the at least one arcuate slot of the carrying handle. This configuration beneficially provides easy engagement and disengagement between the container and the strut.

A connector plug is provided, which can be used in a variety of settings such as the first connector portion or the second connector portion described in the watercraft above. The connector plug comprises a base portion and an insertion portion extending from the base portion for insertion into a cavity of a socket. The insertion portion of the plug defines an interior cavity. The connector plug further includes at least one pin including a first portion extending outwardly from the base portion into the interior cavity and a second portion extending into the base portion. The second portion of the at least one pin includes a seal disposed therearound and disposed between the second portion and the base portion. The connector plug further includes at least one resilient sock disposed around the first portion of the at least one pin, the at least one resilient sock configured to contact a portion of the socket upon insertion therein to electrically isolate the at least one pin from fluid present in the interior cavity of the insertion portion.

In another described example, the plug further comprises at least one pin connector disposed within the base portion, the at least one pin connector including a first end for receiving at least a portion of the second portion of the at least one pin. The pin connector advantageously allows removal and replacement of the pin.

In another described example, the insertion portion of the plug further comprises a substantially cylindrical exterior surface including a first cylindrical portion having a first diameter and a second cylindrical portion having a second diameter greater than the first diameter. This structure forms a stepped diameter around the insertion portion. A first seal is disposed around the first cylindrical portion. A second seal disposed around the second cylindrical portion. The stepped diameter advantageously reduces pressure build-up within the plug when it is inserted into a receiving socket, because the first and second seals can engage an inner surface of the socket at substantially the same time during insertion.

In another described example, the plug further comprises a retaining member removably attached to a surface of the interior cavity, the retaining member including a hole for the first portion of the at least one pin to extend through. The retaining member serves to affix the at least one pin to the connector plug.

A connector socket is provided, which can be used independently or in combination with the connector plug described above. The connector socket has applications in a variety of settings such as the first connector portion or the second connector portion described in the watercraft above. The connector socket comprises a base portion and a receptacle portion extending from the base portion. The receptacle portion defines a cavity for receiving a socket, wherein the socket includes at least one pin. The connector socket further comprises at least one conductor permanently affixed to the base and at least one pin connector removably affixed to the base and extending from the base into the cavity. The pin connector includes a first end having a socket configured to receive the pin of the plug and a second end affixed to the at least one conductor. When the plug is received within the cavity of the receptacle portion, the at least one conductor forms an electrical pathway with the at least one pin of the plug via the at least one pin connector.

In another described example, the socket further comprises a resilient seal between the at least one conductor and the base portion.

In another described example, the socket further comprises a retainer having at least one passage therethrough. The retainer is removably affixed to the base portion such that the retainer secures the at least one pin connector to the base portion and at least a portion of the first end of the at least one pin connector extends into the at least one passage.

In another described example, the socket further comprises a substantially cylindrical internal surface defining the cavity within the receptacle portion, the internal surface including a first cylindrical portion deepest within the cavity and having a first diameter, and the internal surface further including a second cylindrical portion closest to an open end of the cavity and having a second diameter greater diameter than the first diameter. This structure forms a stepped diameter within the receptacle portion. The first cylindrical portion is configured to mate with a first resilient seal of the plug. The second cylindrical portion is configured to mate with a second resilient seal of the plug. The stepped diameter advantageously reduces pressure build-up within the socket when it receives the plug, because the first and second seals can engage the inner surface of the socket at substantially the same time during insertion.

A watertight electronics container is provided, which is configured to mate with an electrically propelled watercraft. The container comprises a housing enclosing a power source. A first connector portion is substantially rigidly affixed to the housing and configured to interconnect with a second connector portion attached to the watercraft. The first connector portion may be integrally formed within the housing, or it may be a separate element. The first connector portion may correspond to either the connector plug or the connector socket described above. In one example, the first connector portion comprises a base portion and at least one internal conductor permanently affixed to the base portion. The internal conductor is electrically coupled to the power source. The first connector portion further comprises a first resilient seal affixed to the at least one internal conductor and forming a first watertight seal between the internal conductor and the base portion. The first connector portion further comprises an external conductor removably affixed and electrically coupled to the internal conductor. The first watertight seal advantageously remains intact upon removal of the external conductor, allowing the external conductor to be field-replaced without compromising the watertight integrity of the electronics container.

In another described example, the watertight electronics container further comprises a resilient seal disposed around the first connector portion and between the first connector portion and an opening in the housing.

In another described example, the first connector portion further comprises a second resilient seal affixed to the external conductor and forming a second watertight seal between the external conductor and the base portion.

In another described example, the housing of the watertight electronics container is configured to mate with and substantially fill a cavity formed in an outer surface of the electrically propelled watercraft.

In another described example, the watertight electronics container further comprises a handle including a gripping portion. An arm having a first end is attached to the gripping portion. The arm has a second end rotatably attached to the container and the arm further includes a slot for receiving a projection of the watercraft. The gripping portion is movable to a first position allowing the first connector portion to be brought into contact with the second connector portion attached to the watercraft, the gripping portion movable to a second position wherein the slot of the arm engages the projection of the watercraft to rigidly secure the first connector portion to the second connector portion.

In another described example, the slot includes a lower cam surface and an upper cam surface for engaging the projection of the watercraft, the lower cam surface engaging the projection when the gripping portion is moved from the first position to the second position and the upper cam surface engaging the projection when the gripping portion is moved from the second position to the first position.

In another described example, the lower cam surface includes an inner detent and an outer detent, the projection positioned within the inner detent when the gripping portion is in the second position, and the projection positioned within the outer detent at a position intermediate the first and second positions when the gripping portion is moved from the first to the second position.

A field serviceable wet-mate connector is provided comprising a first connector portion and a second connector portion. In one example, the first connector portion comprises a first fixed conductor disposed in the first connector portion such that the first fixed conductor is configured to form an electrically conductive pathway with a first wire attached to the first connector portion. The first connector portion further comprises a first replaceable conductor that is slidably connected to the first fixed conductor. A first replaceable seal is disposed between the first replaceable conductor and the first connector portion such that the first replaceable seal forms a first watertight barrier. The second connector portion comprises a second fixed conductor disposed in the second connector portion such that the second fixed conductor is configured to form an electrically conductive pathway with a second wire attached to the second connector portion. The second connector portion further comprises a second replaceable conductor slidably connected to the second fixed conductor such that the second replaceable conductor is configured to form an electrically conductive pathway with the first replaceable connector when the second connector portion is mated to the first connector portion. A second resilient fixed seal disposed between the second fixed conductor and the second connector portion such that the second resilient fixed seal forms a second watertight barrier. A second resilient replaceable seal is disposed between the second replaceable conductor and the second connector portion such that the second replaceable seal is configured to form a third watertight barrier. The field serviceable wet-mate connector further comprises a resilient connector seal configured to form a fourth watertight barrier between the second connector portion and the first connector portion when the second connector portion socket is mated to the first connector portion to form a watertight cavity around at least a part of the first replaceable conductor and the second replaceable conductor even when the third watertight barrier is not present in the connector.

In another described example, the first connector portion further comprises a resilient boot disposed around the first replaceable conductor such that the resilient boot is configured to form a fifth watertight barrier separating the first replaceable conductor and the second replaceable conductor from the watertight cavity formed when the second conductor portion is mated to the first conductor portion.

In another described example, the second connector portion further comprises a removably attached retainer. The retainer includes at least one hole therethrough that at least a portion of the second replaceable conductor extends through when the retainer is attached to the second connector portion. The retainer secures the second replaceable conductor to the second connector portion when the retainer is attached to the second connector portion.

In another described example, when the retainer is removed from the second connector portion the second replaceable conductor is capable of being slidably removed from the second connector portion.

In another described example, the field serviceable wet-mate connector further comprises a plug insertion portion having an annular exterior surface including a first groove having a first diameter and a second groove having a second diameter greater than the first diameter. The resilient connector seal further comprises a first seal disposed in the first groove and a second seal disposed in the second groove. The fourth watertight barrier is formed by the first seal and the second seal.

A method of inserting a power source container into a watercraft device is provided. The method includes providing a power source container including a first connection portion at a first end of the container. The method further includes providing a watercraft device including a flotation portion. The watercraft devices has a strut having an upper end affixed to the flotation portion and a lower end extending from the flotation portion, and a motor disposed on the strut. The flotation portion further includes a cavity for receiving the power source container and a second connection portion disposed within the cavity. The method includes positioning a second end of the container in the cavity of the deck and pivoting the first end of the container toward the flotation portion to bring the first connection portion into contact with the second connection portion.

In another described example, the power source container further comprises a handle at the first end thereof for pivoting the first end of the container toward the flotation portion. In certain examples, the handle includes a gripping portion and an arm. The arm has a first end attached to the gripping portion and a second end rotatably attached to the container. The arm also has a slot for receiving a projection of a watercraft. In certain examples, the method further includes rotating the gripping portion of the handle to a first position in which the first connection portion and the second connection portion are aligned and in contact with each other; and further rotating the handle to a second position in which the first connection portion and the second connection portion form a watertight seal to prevent a fluid from entering a space between the first connection portion and the second connection portion. In certain examples, the slot of the arm includes a lower cam surface and an upper cam surface, wherein rotating the gripping portion of the handle to the first position includes receiving a projection of the strut within the slot, the projection moving along the lower cam surface to an outer detent of the lower cam surface. Rotating the gripping portion of the handle from the first position to the second position includes the projection moving along the lower cam surface to an inner detent of the lower cam surface.

In another described example, pivoting the first end of the container brings at least one conductor of the first connection portion into contact with a conductor of the second connection portion to form an electrically conductive pathway between the first and second connection portion.

DETAILED DESCRIPTION

A connector is disclosed herein that allows electronics or electrical components to be connected and disconnected in wet, sandy, muddy, or otherwise harsh environments. The connector is made up of a connector socket and a connector plug that may be inserted into the connector socket. The connector socket includes one or more electrical conductors that are brought into electrical communication with corresponding conductors of the connector plug when the connector plug is inserted into the connector socket, thereby creating one or more electrical pathways through the connector. Where two or more electrical pathways are provided within the connector, the electrical pathways may be isolated from one another even if fluid is present within the connector. Both the connector socket and the connector plug may be watertight, inhibiting fluid and other debris from passing through the connector socket or connector plug and damaging sensitive electrical components inside otherwise watertight enclosures even when not connected to one another.

Figure 1:
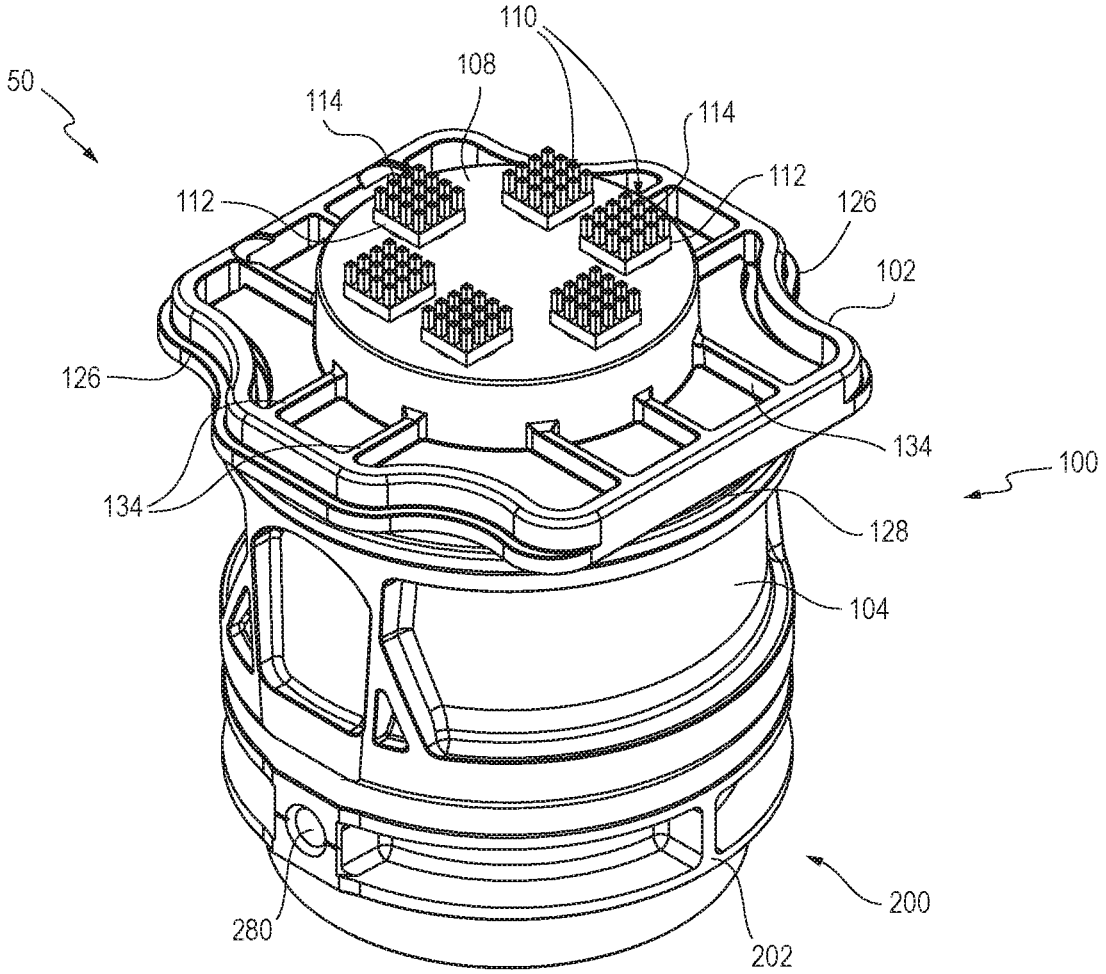
FIG. 1 is a top perspective view of a socket and a plug of a connector in a connected configuration.
Figure 2:
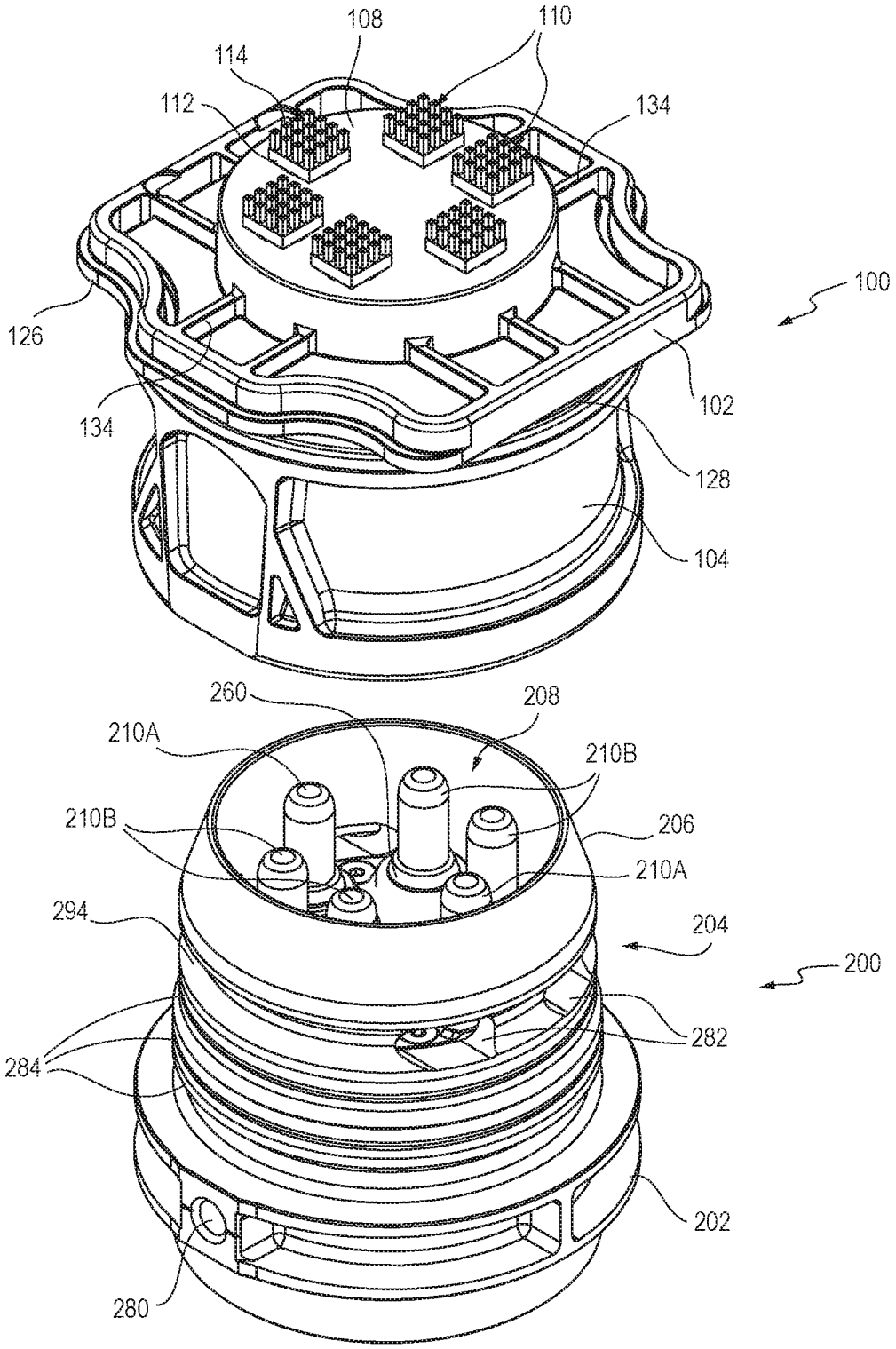
FIG. 2 is a top perspective view of the socket and plug of the connector of FIG. 1 shown in a separated configuration.
Figure 3:
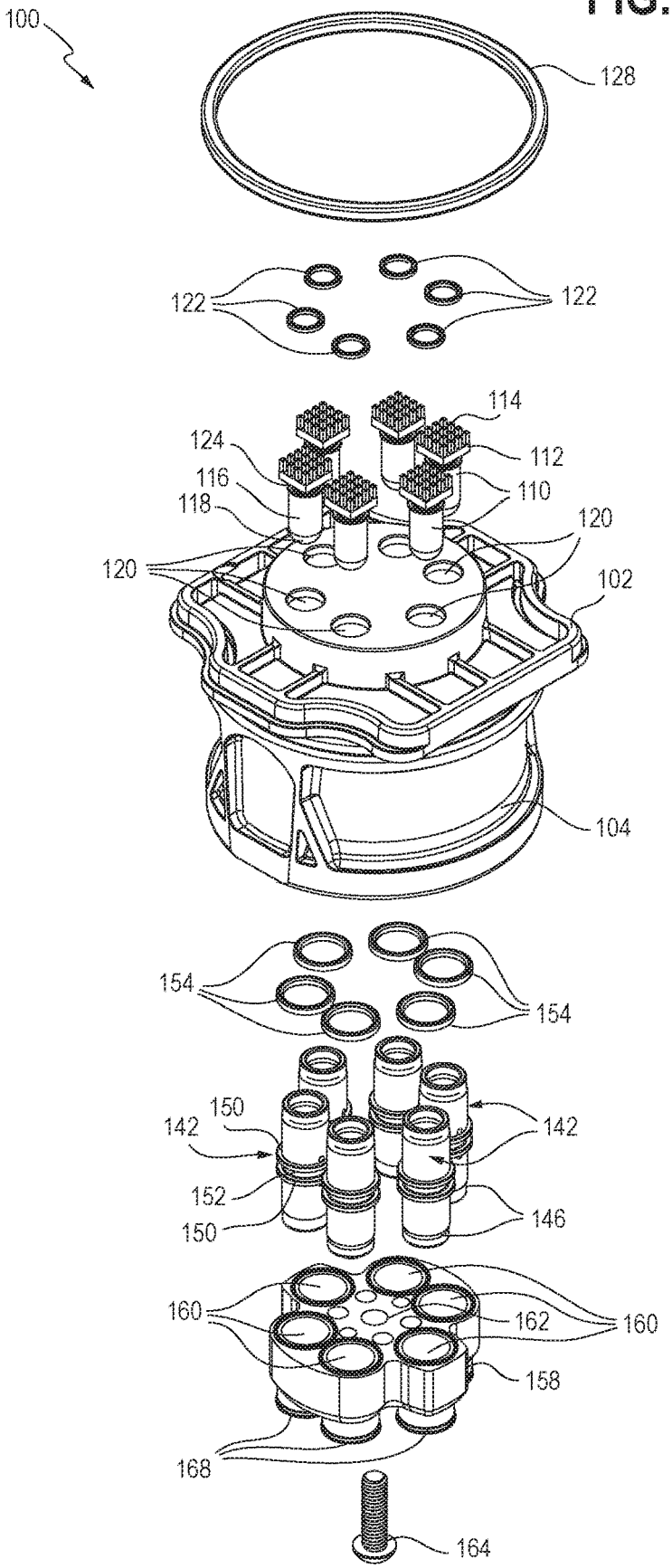
FIG. 3 is an exploded top perspective view of the socket of the connector of FIG. 1.

With reference to FIGS. 1 and 2 a connector 50 is shown. The connector 50 includes a socket 100 and a plug 200. As shown in FIG. 1, the connector 50 is in a connected configuration with the plug 200 inserted into the socket 100. With reference to FIG. 2, the connector 50 is shown in a separated configuration with the plug 200 removed from the socket 100. The connector 50 thus provides a removable connection between the socket 100 and the plug 200.

With reference to FIGS. 1-3, 5-8C, the socket 100 includes a base 102 and a receptacle portion 104 extending from the base 102. In the embodiment shown, the base 102 includes a central portion 108 in which one or more electrical contacts 110 may be mounted. The contacts 110 include a base 112, a plurality of mounting contacts 114 extending from one end of the base 112, a shaft 116 extending from the opposite end of the base 112, and a rounded tip 118 at the end of the shaft 116. The central portion 108 defines a plurality of holes 120 (illustrated in FIG. 3).

With reference to FIGS. 3, 6B-6C, 7C and 8C, the electrical contacts 110 may be inserted into the holes 120 to be mounted to the base 102. The contacts 110 are secured within the holes 120 when the socket is installed within a connector housing or cable, where a circuit board or other structure (not shown) prevents the contacts 110 from sliding out of the holes. A seal 122, such as an O-ring, may be disposed around the base 112 and/or shaft 116 to create a sealed connection between the contacts 110 and the base 102. The seal 122 may inhibit fluid from passing through holes 120 when the contacts 110 are inserted therein. In the embodiment shown, the contacts 110 include a groove 124 extending around the circumference of the shaft 116 near the base 112 of the contacts 110. The groove 124 may receive the seal 122 (e.g., an O-ring) and prevent the seal 122 from moving relative to the contacts 110.

Referring back to FIGS. 1 and 2, the plurality of mounting contacts 114 extending from the base 112 of the contacts 110 are leads which may be used for mounting the contacts 110 to a circuit board. In other embodiments, the base 112 of the contacts 110 may be configured to connect to one or more electrically conducting wires or contacts. As one example, the base 112 of the contacts 110 may include a terminal for receiving a wire. The contacts 110 may be formed of a conductive metal. Preferred embodiments use brass, silver, or copper.

Figure 5:
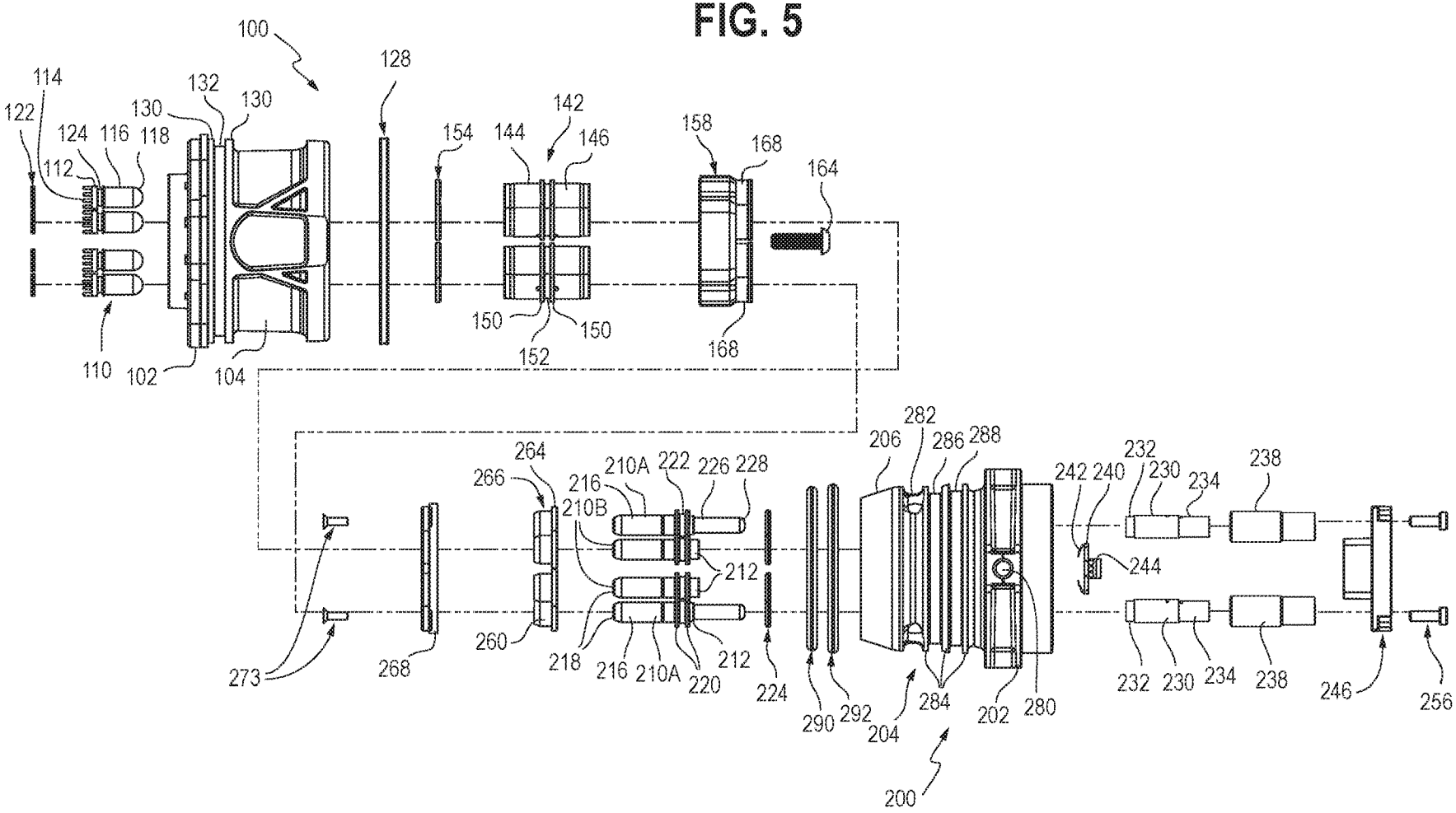
FIG. 5 is an exploded side elevation view of the socket and the plug of the connector of FIG. 1.
Figure 10A:
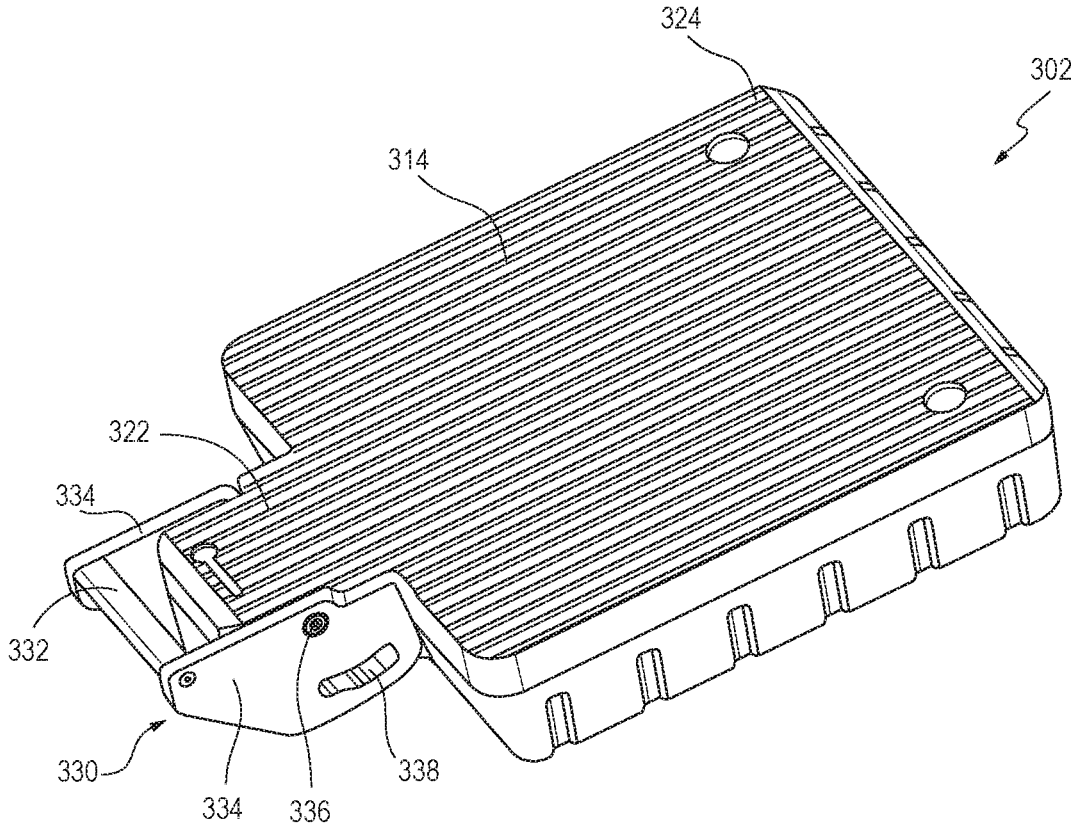
FIG. 10A-B show top and bottom perspective views, respectively, of a container including the socket of the connector of FIG. 1.
Figure 10B:
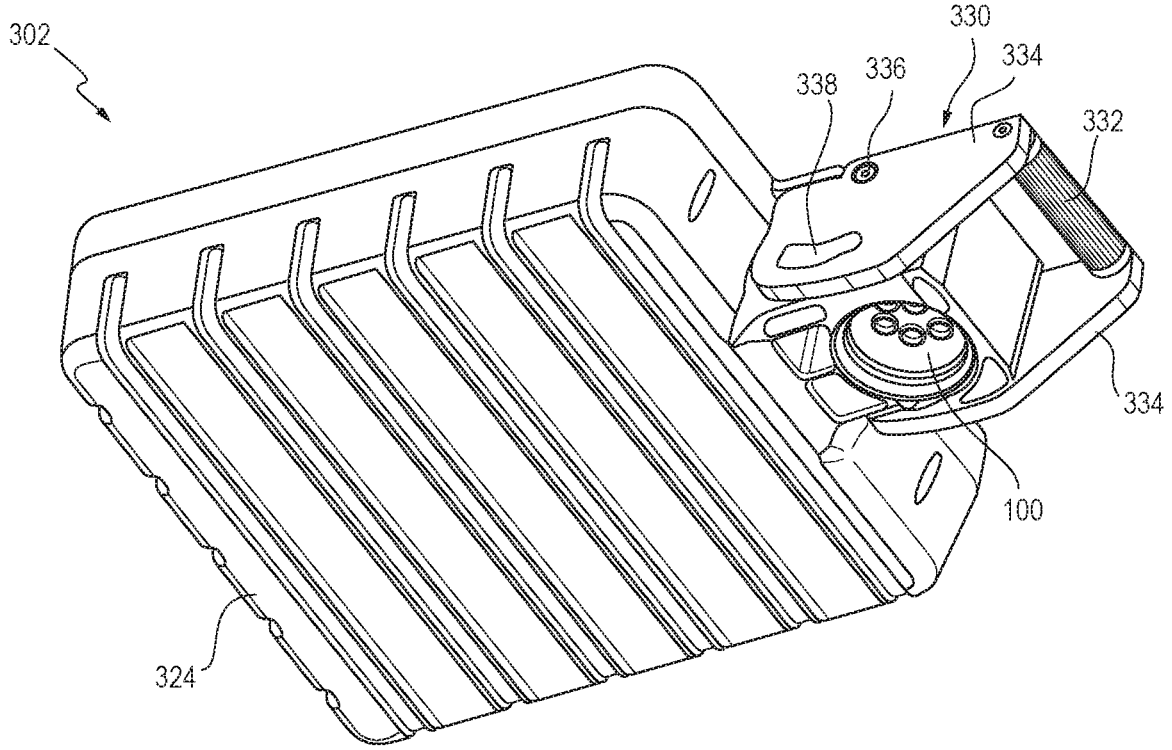

The socket 100 may be mounted to a surface of an object, such as the wall of a container housing electronics and/or a power source. For example, as shown in FIGS. 10A-B, the socket 100 may be mounted to a portion of a container 302. As shown, the base 102 of the socket 100 includes a lip 126 extending outward from the periphery of the base 102. The receptacle portion 104 of the socket 100 may be extended through a hole in a mounting surface, such as the wall of a container (not shown). The lip 126 may contact the interior surface of the wall to prevent the socket 100 from passing through the hole in the mounting surface. The interior surface of the wall includes a pocket to receive the lip and secure the connector socket 100 to the container. The socket 100 includes a seal 128 disposed on the exterior surface of the base 102 which contacts the surface to which the socket 100 is mounted to inhibit fluid from passing through the hole in the surface. As shown in FIG. 5, the socket 100 includes two ribs 130 extending outwardly from the base 102 of the socket 100 forming a groove 132 therebetween. The seal 128 may be positioned within the groove 132 to retain the seal 128. In the embodiment shown, the seal 128 is a quad-ring, but an O-ring could also be used. In other embodiments, a permanent seal such as an adhesive may be used, or the connector socket 100 may be friction welded or molded within the structure of a container or as a plug integrated at the end of a cable. In other embodiments, a seal may be positioned on the lip 126 such that the seal extends between the lip 126 and the interior surface of the wall or surface to which the socket 100 is mounted. Such a lip seal may include an O-ring, quad-ring, gasket, or sealing adhesive as examples.

The socket 100 may be formed of a plastic material, for example, by injection molding. As shown in FIGS. 1 and 2, the base 102 of the socket 100 may include a web 134 structure to reduce the amount of material used in forming the base 102 while providing strength to the base 102.

Figure 6A:
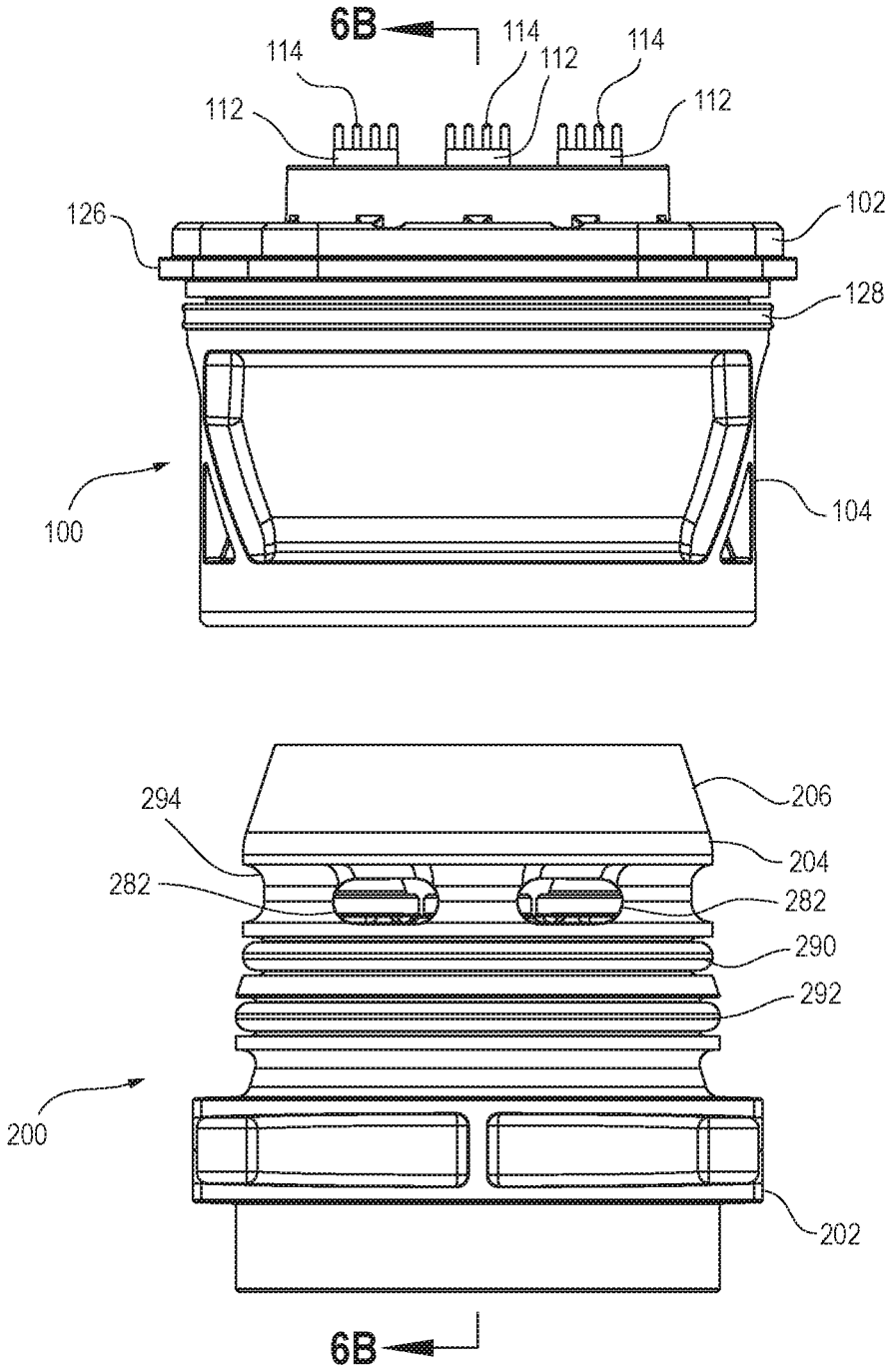
FIG. 6A is a side elevation view of the connector of FIG. 1 shown in the separated configuration.
Figure 6B:
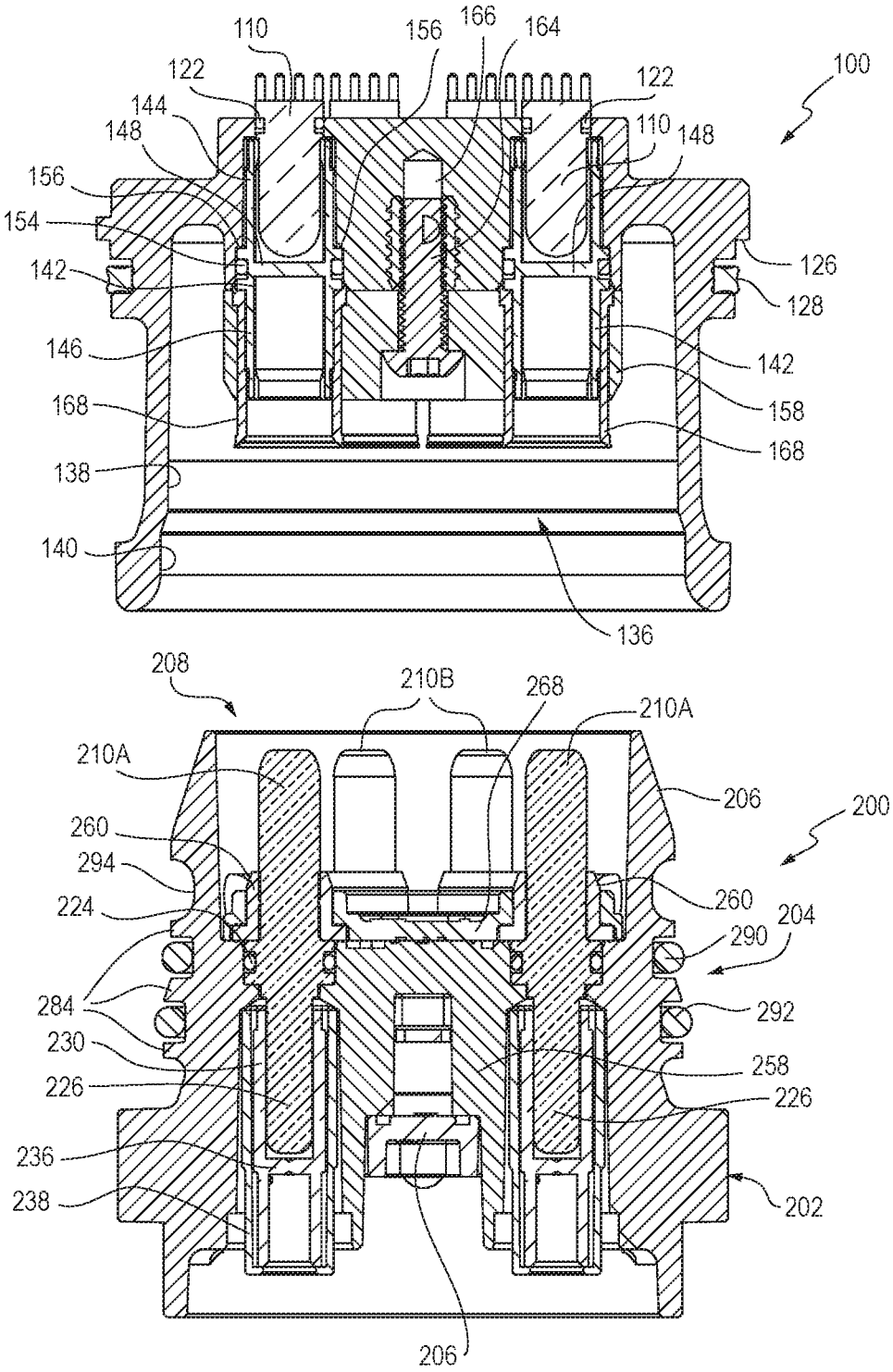
FIG. 6B is a cross-section view of the connector of FIG. 1 taken along line 6B-6B of FIG. 6A.
Figure 6C:
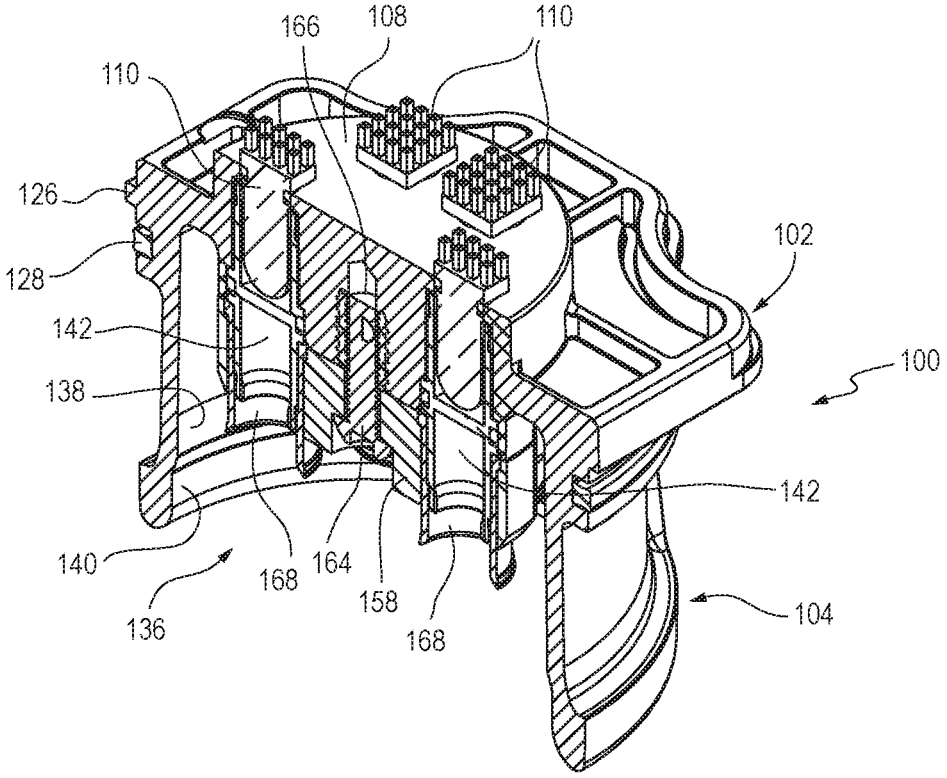
FIG. 6C is top perspective view of the cross-section of the connector shown in FIG. 6B.
Figure 6C:
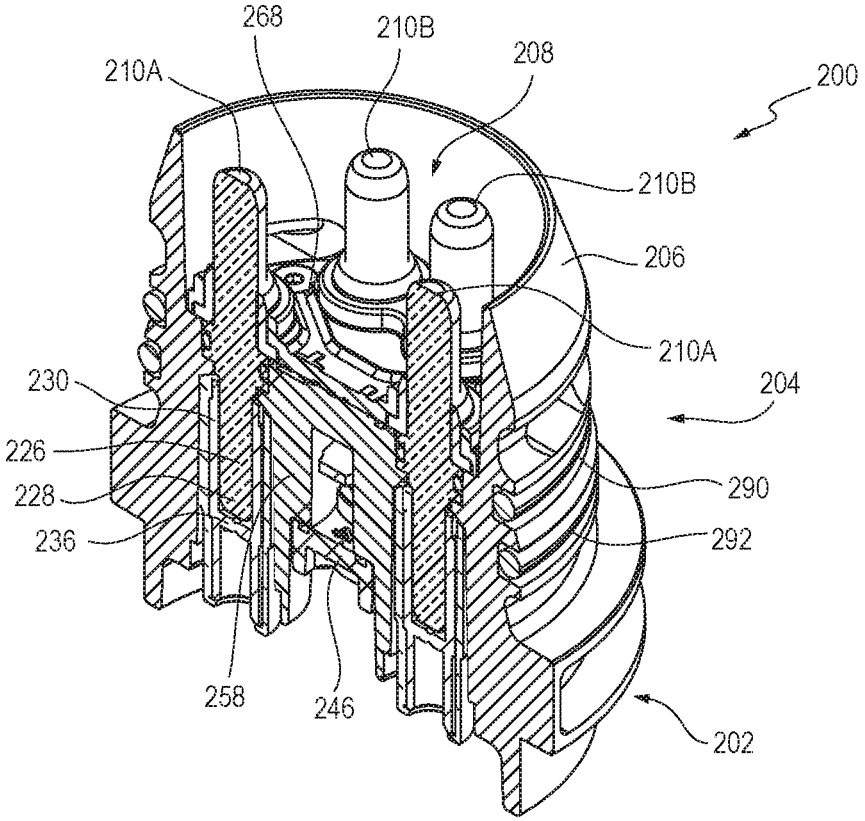
Figure 7A:
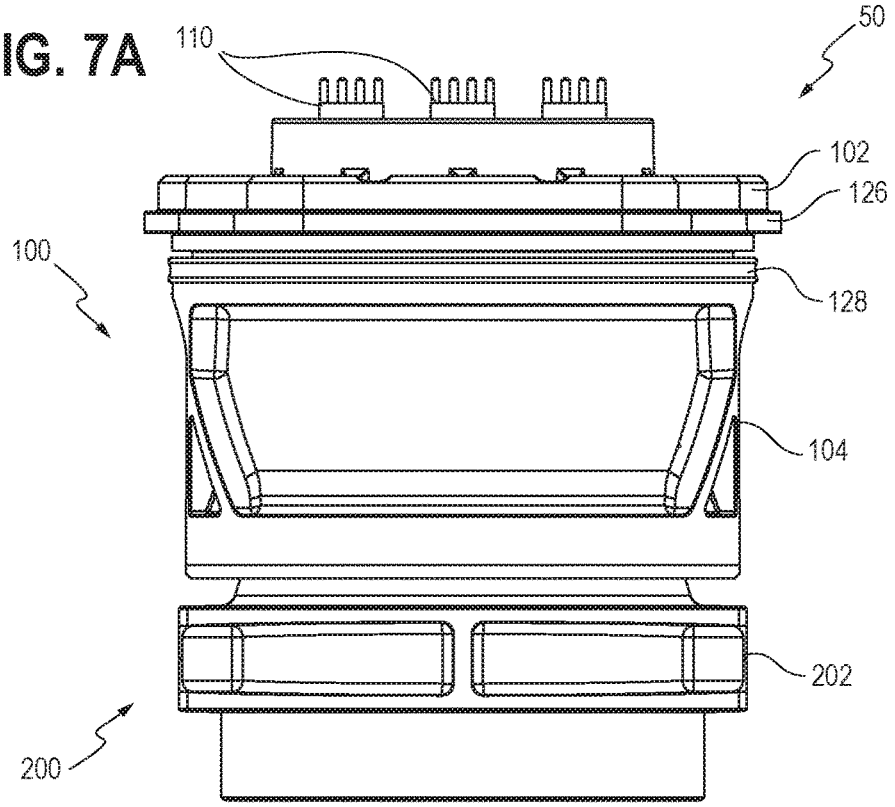
FIGS. 7A-B are side elevation and top plan views, respectively, of the connector of FIG. 1 in the connected configuration.
Figure 7B:
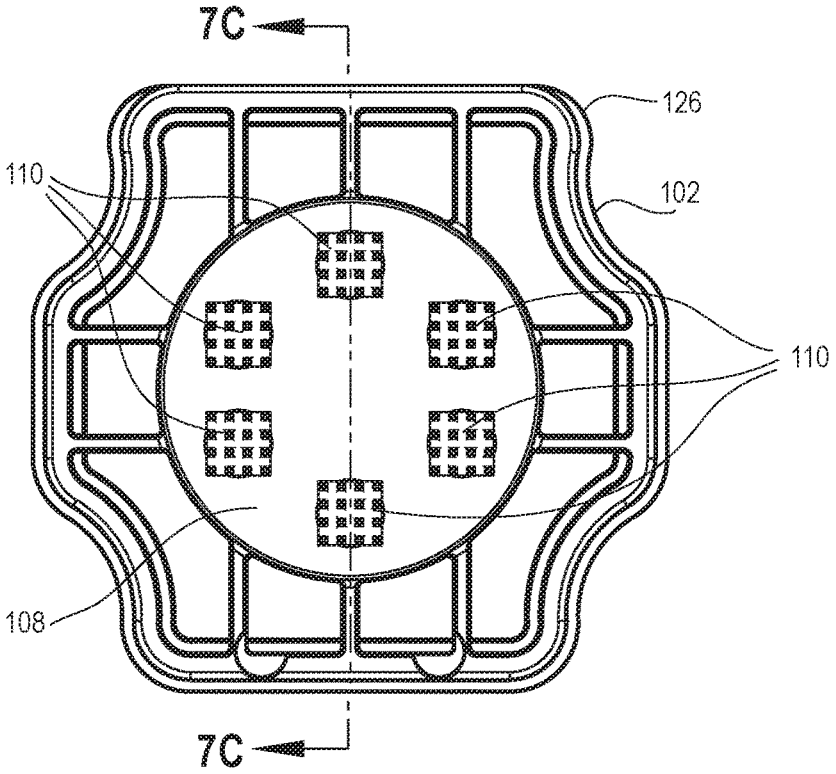
Figure 7C:
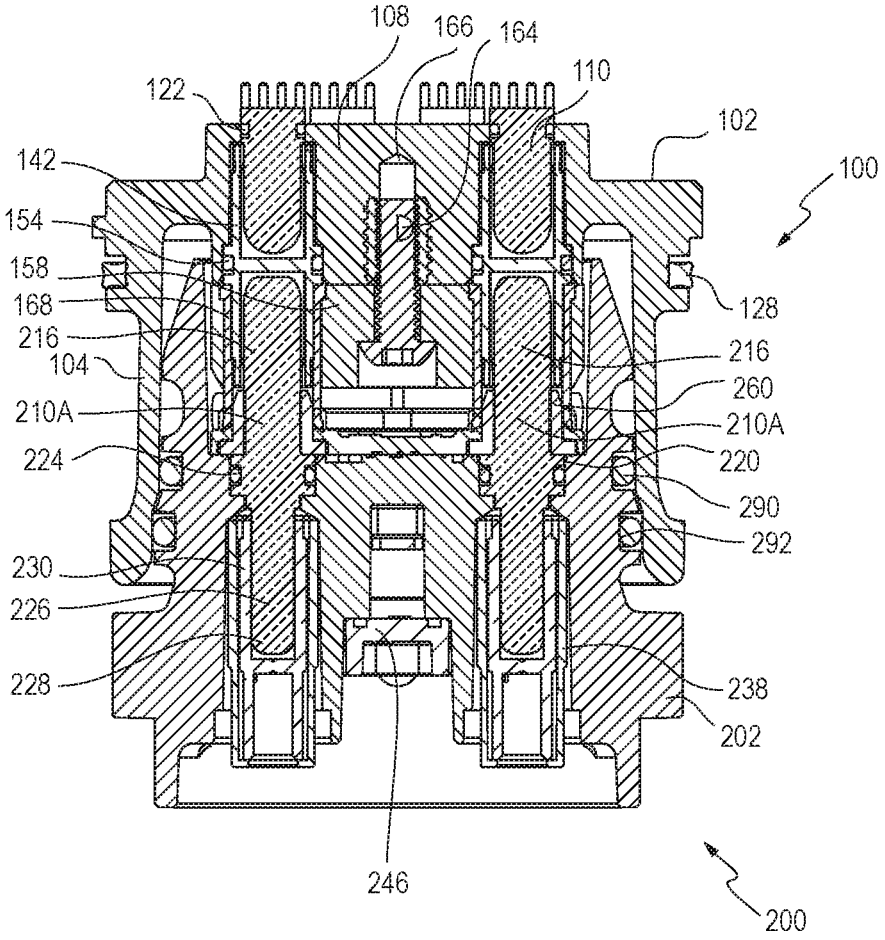
FIG. 7C is a cross-section view of the connector of FIG. 1 taken along line 7C-7C of FIG. 7A.
Figure 8A:
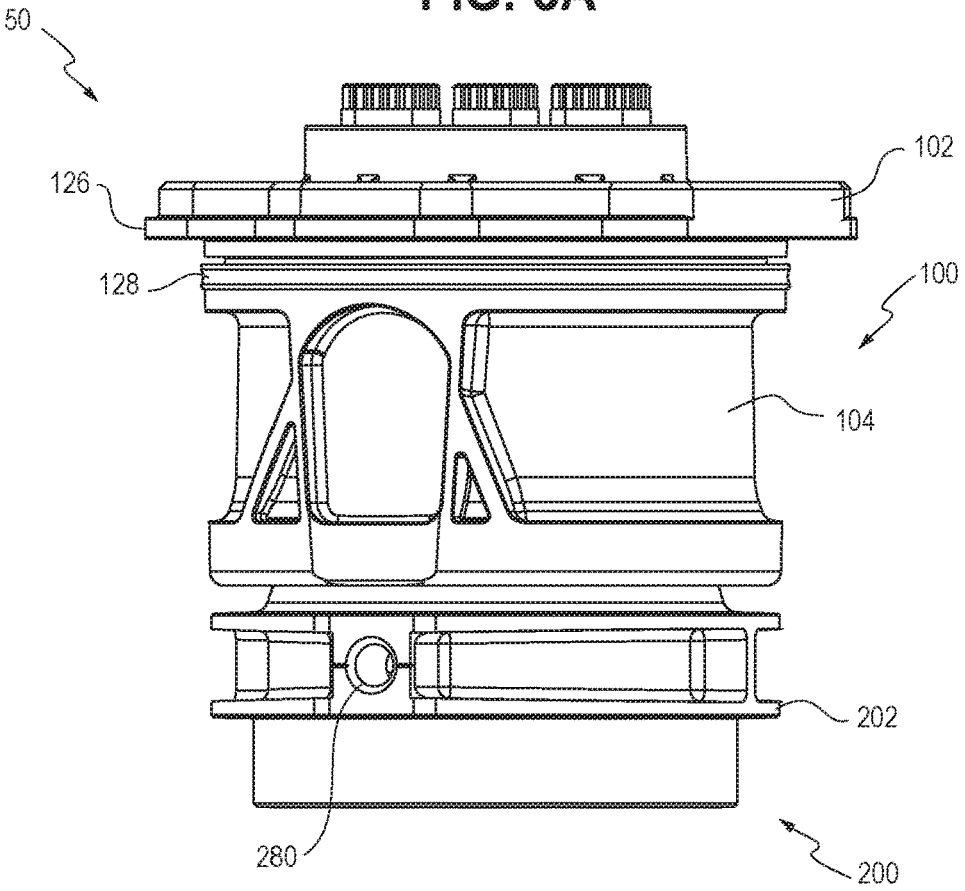
FIG. 8A-B are side elevation and top plan views, respectively, of the connector of FIG. 1 partially rotated about the longitudinal axis of the connector.
Figure 8B:
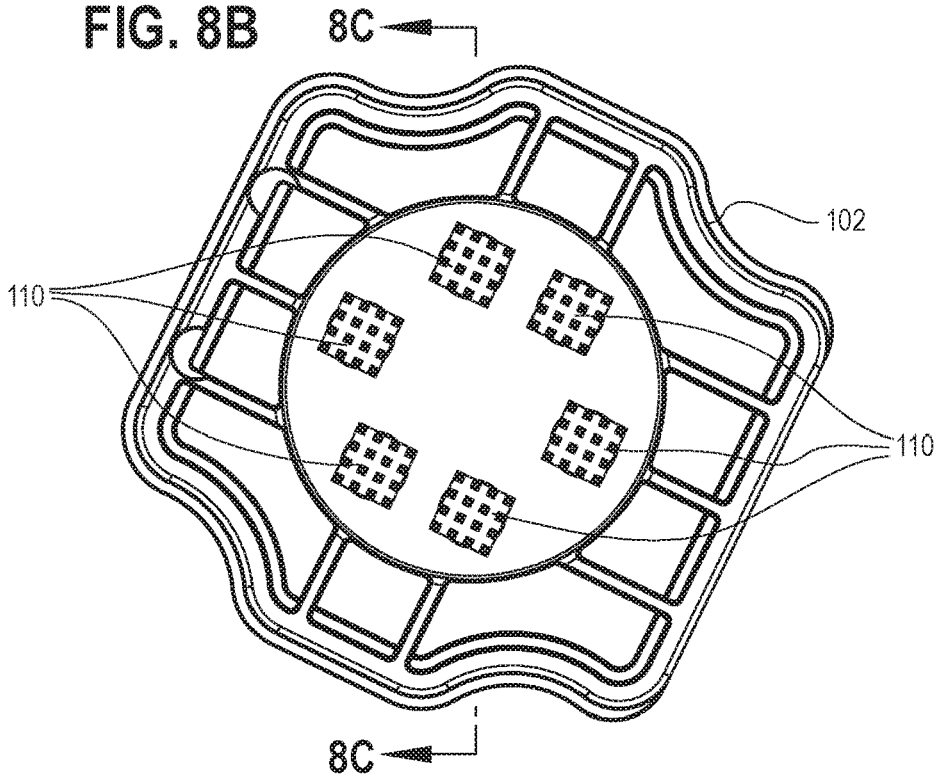
Figure 8C:
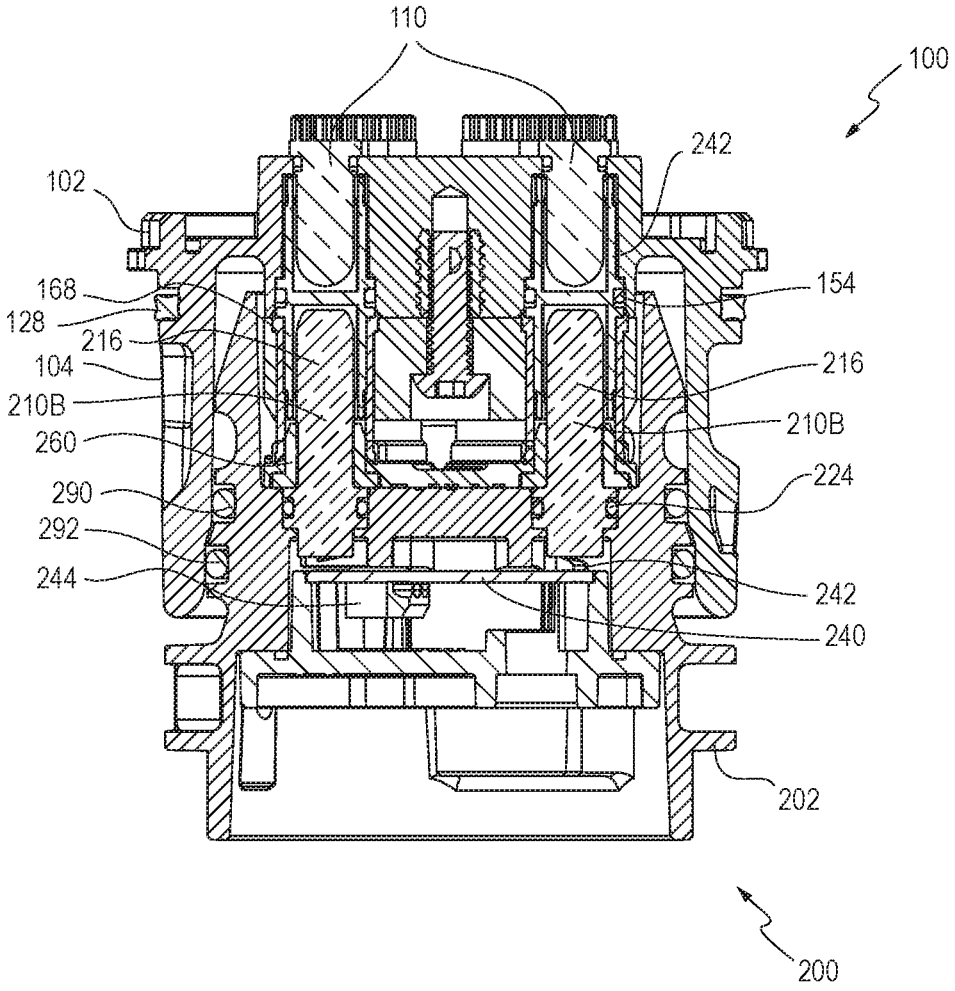
FIG. 8C is a cross-section view of the connector of FIG. 1 taken along line 8C-8C of FIG. 8A.

The receptacle portion 104 extends from the base 102 of the socket 100. The receptacle portion 104 may be an annular wall extending from the base 102 of the socket 100. As shown in FIG. 6B, the receptacle portion 104 defines an internal cavity 136 for receiving the plug 200. In the embodiment shown, the receptacle portion 104 angles slightly outward as the receptacle portion 104 extends from the base 102. The receptacle portion 104 includes an inner sealing surface 138 and an outer sealing surface 140 against which seals 290, 292 of the plug 200 contact to seal the internal cavity 136 from fluid and debris when the plug 200 is inserted into the receptacle portion 104. The inner sealing surface 138 has a smaller diameter than the outer sealing surface 140. This enables the seals 290, 292 of the plug 200 to be brought into contact with the sealing surfaces 138, 140 at approximately the same time during insertion of the plug 200, advantageously reducing the distance the plug 200 is slid within the receptacle portion 104 after a seal is formed reducing wear on the O-rings and enhancing the useable lifetime of the connector 50. Sliding the plug 200 further into the internal cavity 136 requires the air sealed within the internal cavity 136 to be compressed which makes inserting the plug 200 into the socket 100 progressively more difficult after the seal is formed. By using seals having different diameters, the connector 50 benefits from having a double-seal, while minimizing the need to compress the air trapped within the internal cavity 136 when connecting the plug 200 to the socket 100.

With reference to FIGS. 3, 5, 6B-6C, 7C, and 8C, the socket 100 includes pin connectors 142 disposed within each of the holes 120 of the central portion 108. In a preferred embodiment, the pin connectors 142 serve as a field-replaceable wear component that can be removed and replaced without removing the connector socket 100 from a container or a cable in which it is mounted. The pin connectors 142 include an inner socket 144 on one end which receives a portion of the shaft 116 and the rounded tip 118 of one of the contacts 110. The pin connectors 142 further include an outer socket 146 on the other end which receive a portion of one of the pins 210A or 210B of the plug 200. The inner and outer sockets 144, 146 may share a dividing wall 148 separating the inner socket 144 from the outer socket 146. The pin connector 142 further includes a pair of ribs 150 disposed on the outer surface thereof and extending about the circumference of the pin connector 142. The ribs 150 define or form a recess or groove 152 for receiving a seal 154. The seal 154 may be, as an example, an O-ring. When the pin connector 142 is inserted within hole 120 of the socket 100, the seal 154 extends between the pin connector 142 and the walls of the holes 120 of the socket 100, inhibiting fluid and debris from passing around the pin connector 142.

With reference to FIGS. 6B-C, 7C, and 8C, the pin connectors 142 may be inserted into the holes 120 of the socket 100 through the internal cavity 136 of the socket 142. The socket 100 may include a step or stop 156 within the holes 120 that a rib 150 contacts, preventing the pin connector 142 from passing through the hole 120 and setting the position of the pin connector 142 within the hole 120. As the pin connector 142 is inserted into the hole 120, a contact 110 is inserted into the inner socket 144 of the pin connector 142. The rounded tip 118 of the contact 110 may aid in guiding or aligning the pin connector 142 as the contact 110 passes into the inner socket 144. The pin connectors 142 are formed of a conductive metal such as brass, silver, or an alloy.

A retainer 158 may be attached to the base 102 of the socket 100 within the internal cavity 136. The retainer 158 includes holes 160 therethrough for receiving the outer sockets 146 of the pin connectors 142 and the pins 210A and 210B of the plug 200. The retainer 158 also includes a hole 162 for receiving a fastener 164, such as a screw, to attach the retainer to the socket 100. As shown in FIG. 6B, base 102 of the socket 100 may include a hole 166 for receiving the fastener 164. The hole 166 may be a threaded hole for receiving the threads of the fastener 164. In some embodiments, an insert having external threads may be threaded into the hole 166. The insert may further include a threaded hole therein for receiving the fastener 164 to thereby attach the retainer 158 to the base 102. The retainer 158 is removably fastened to the socket 100 to allow access to the pin connectors 142 for servicing. The pin connectors 142 may need to be replaced, removed for cleaning, and/or one or more of the seals 154 may need to be replaced. Once the retainer 158 has been removed, the pin connectors 142 may be slidingly removed from and inserted into the holes 120 of the socket 100. The pin connectors 142 may be serviced and removed even in wet environments, because the contacts 110 provide a seal 122 inhibiting fluid and debris from passing through holes 120 even when the pin connectors 142 are removed. In a preferred embodiment, the retainer 158 is attached to the connector socket base 102 by a single fastener 166. This preferred approach minimizes the skill required to secure the pin connectors 142 replacing, cleaning, or otherwise servicing the pin connectors 142. For example, the servicer removes the retainer 158, removes one or more of the pin connectors 142, inserts the new or clean pin connectors 142 into the holes 120, and fastens the retainer 158 to the socket 100. The servicer does not need to insert each pin connector 142 to a certain distance to make contact with the contacts 110 as attachment of the retainer 158 may cause the pin connectors 142 to be fully inserted. In other embodiments, the pin connectors 142 may be inserted into the holes 120 by screwing the pin connectors 142 into the holes 120. The pin connectors 142 may have threads disposed on a portion of the outer surface thereof for engaging complementary threads within the holes 120. Allowing the pin connectors 142 to be attached by slidingly inserting the pin connectors into the holes 120 of the socket 100 is also advantageous as the pin connectors 142 may be inserted to make contact with the pins 110 even if there is debris within the holes 120. In embodiments where the pin connectors 142 are attached by threads, over time the threads may become damaged by debris, which might also prevent the pin connectors 142 from being fully threaded into the socket 100. In either embodiment, even if the servicer inadvertently forgets to insert a pin connector 142, the seal 122 of the contacts 110 is designed to prevent fluid and debris from passing through the socket 100 and potentially damaging the electrical equipment the socket 100 is attached to.

In other embodiments, the retainer 158 may be removably attached to the socket 100 by other means. In one example, a bolt extends from the base 102 of the socket 100 into the internal cavity 136 and passes through hole 162 of the retainer. A nut is then threaded onto the bolt to secure the retainer 158 to the socket 100. In another example, the retainer 158 clips or snaps onto the socket 100. In yet other embodiments, the retainer 158 is permanently affixed to the socket 100.

The retainer 158 may include a resilient socket boot 168 within each hole 160 that receives the outer socket 146 of the pin connectors 142. The socket boot 168 extends between the outer socket 146 and the retainer 158. The socket boot 168 may be resilient and formed of a soft or hard rubber material which may provide additional sealing capabilities to further inhibit fluid from passing through or into holes 120. The socket boot 168 extends beyond the retainer 158 and into the internal cavity 136. The socket boot 168 may engage a portion of the plug 200 when the plug is inserted into the socket 100. For example, the plug may contact a resilient plug boot 260 of the plug 200 to further seal against fluid and debris from entering the holes 120 and/or the outer socket 146 of the pin connectors 142. The socket boot 168 may receive the plug boot 260 of the plug to provide this seal and electrically isolate each pin connector 142 of the socket 100 and the corresponding pin 210A,B of the plug 200 from the other pin connectors 142 and pins 210A,B when the plug 200 is inserted into the socket 100.

With reference to FIGS. 1, 2, and 4-8C the connector 50 includes a plug 200. The plug 200 includes a base 202 and an insertion portion 204 extending from the base 202. The insertion portion 204 may be an annular wall extending from the base 202. The insertion portion 202 may be complementarily sized and shaped to fit within the interior cavity 136 of the socket 100. For example, the external surface of the insertion portion 204 may angle inward as the insertion portion 204 extends away from the base 202 where the internal surface of the receptacle portion 104 of the socket 100 angles slightly outward as it extends from the base. The distal end of the insertion portion 204 (i.e., away from the base 202) may include a tapered tip 206. The tapered tip 206 may aid to guide and/or align the plug 200 as the plug 200 is inserted into the socket 100.

The insertion portion 204 defines an internal cavity 208. A plurality of pins 210A and 210B extend into the internal cavity 208 from a central portion 258 of the plug 200. A portion of each of the pins 210A and 210B may be inserted into holes 262 of the central portion 258. In the embodiment shown, the pins 210A,B do not extend beyond the end of the insertion portion 204. This reduces the likelihood that the pins 210A and 210B inadvertently contact another object causing the pins 210A and 210B to bend or otherwise be damaged. In the embodiment shown, pins 210A are used to conduct power whereas pins 210B are used to conduct communication signals. The power pins 210A may conduct high current or provide high voltage used to power electrical equipment including as examples, an electric motor, an electronic speed controller, an infotainment system, a navigation system, a communication system, etc. The communication pins 210B may conduct electronic signals including information for an electronic device. The communication pins may conduct electronics signals sent using one or more defined communication protocols. By way of example, the communication signals may follow the controller area network (CAN) protocol (ISO 11898). By way of further example, communication signals may transfer data at a bit rate of 250 kbps or 500 kbps, however, communication signals of other bit rates may be used. In other embodiments, all of the pins are power pins 210A. In yet other embodiments, all of the pins are communication pins 210B. Any combination of power pins 210A and communication pins 210B may be used, however. While the embodiments shown show six pins 210A,B on the plug 200 and six pin connectors 142 of the socket 100, in other embodiments one or more pins 210A,B and corresponding pin connectors 142 may be used. For example, the plug 200 may include a single pin 210A or 210B and the socket 100 may include a single pin connector 142 for receiving the single pin 210A or 210B. As another example, the plug 200 may include eight pins (e.g., 210A and/or 210B) and the socket 100 may include eight pin connectors 142 arranged to receive the eight pins 210A and/or 210B.

With reference to FIG. 5, the pins 210A and 210B include a base 212 and a shaft 216 extending from the base 212. The pins 210A and 210B include a rounded tip 218 disposed at the end of the shaft 216A opposite the base 212. At the base 212, the pins 210A and 210B include ribs 220 which form an annular recess or groove 222 into which a seal 224 may be placed. The seal 224 may be, as an example, an O-ring. The pins 210A and 210B may be slidably inserted into and slidably removed from the holes 262 of the central portion 258 of the plug 200 such that the seal 224 extends between the pins 210A and 210B and the central portion 258 of the plug 200, thereby inhibiting fluid from passing through the holes 262 (see FIG. 4) of the central portion 258. The pins 210A and 210B are formed of a conductive material. In one form, the pins 210A and 210B are formed of a Beryllium-Copper alloy. In another form, the shaft 216 and rounded tip 218 are formed of a Beryllium-Copper alloy. The pins 210A,B may also be formed of brass, silver or an alloy.

The power pins 210A further include an inner shaft 226 which extends away from the base 212 opposite the direction of the shaft 216. The inner shaft 226 may include a rounded tip 228 disposed on the end thereof. The inner shaft 226 is received within a pin socket 230 within the base 202 of the plug 200. The pin socket 230 may include a socket portion 232 and a terminal portion 234. The socket portion 232 may include an annular wall configured to receive the inner shaft 226 of the pin 210A. The power pin 210A may be slidingly inserted into the socket portion 232 by sliding the inner shaft 226 of the power pin 210A into a hole 262 of the plug 200 and into the socket portion 232 to form an electrical pathway between the power pin 210A and the pin socket 230. The terminal portion 234 is configured to receive a conductive wire. The terminal portion 234 may be a wire terminal that engages a wire to secure the wire to the pin socket 230. The terminal portion 234 may be divided from the socket portion 232 by a dividing wall 236 (see FIG. 6B). A tubular wire insulator 238 may be placed around the pin socket 230 or a portion thereof and a portion of the wire (not shown) connected to the terminal portion 234. The wire insulator 238 may tightly or elastically engage the pin socket 230 and wire to aid in securing the wire to the terminal portion 234 and resist motion of the wire out of the terminal portion 234. In other embodiments a wire gland may be used to secure the wire to the terminal portion 234 of the pin socket 230. The wire connected to the pin socket 230 may be electrically coupled to provide power to an electric motor, an electronic speed controller for a motor, an infotainment system, a navigation system, a communication system, etc.

Figure 4:
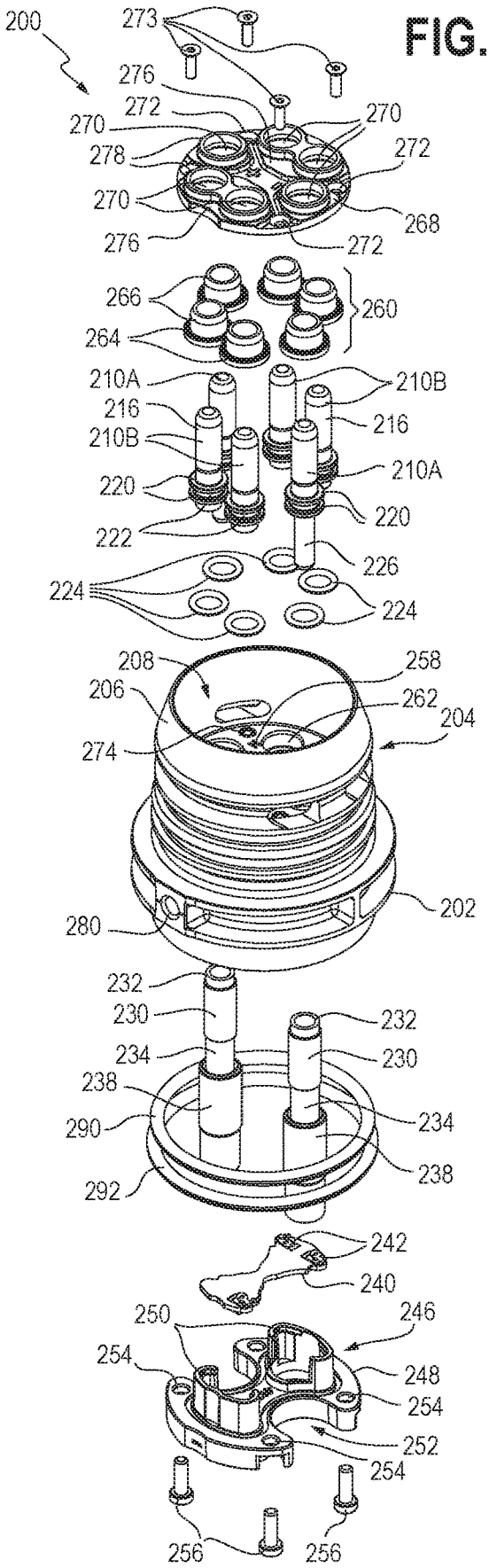
FIG. 4 is an exploded top perspective view of the plug of the connector of FIG. 1.

The base 212 of the communication pins 210B may be used as a contact for mounting to or engaging a complementary contact of a circuit board 240, such as a printed circuit board (PCB). As shown in FIGS. 4 and 5, the circuit board 240 includes a plurality of contacts 242 that engage the base 212 of the communication pins 210B. The contacts 242 are shown as spring contacts, however, other contact types may be used. In preferred embodiments, the connection between the base 212 of the communication pins 210B and the contacts 242 of the circuit board 240 is not permanent to allow the pins 210B to be removed and replaced. The circuit board 240 may include a contact 242 for each pin 210B. In the embodiment shown, only three contacts 242 are provided. The number of contacts 242 may be limited to the number of pins 210B that are being used to send signals. The circuit board 240 acts as a junction box and further includes wire terminals 244 that receive wires. The circuit board 240 may include a wire terminal 244 for each contact 242 on the circuit board 240. Each wire terminal 244 may be electrically coupled to one of the contacts 242. In the embodiment shown, there are only three wire terminals 244 since there are only three contacts 242 on the circuit board 240, for example respectively providing ground, CAN high (CANH), and CAN low (CANL). In other embodiments, however, a wire terminal 244 for each pin 210B may be provided. The wires connected to the wire terminals may extend to and provide communication signals to electronics, for example, to an electronic speed controller for an electric motor.

Referring now to FIG. 4, the circuit board 240 may be attached to the plug 200 by a lower retaining element 246. The lower retaining element 246 may include body 248 from which walls 250 extend. The walls 250 may be shaped to receive the circuit board 240 and retain the circuit board 240. The combination of the base 202 and the lower retaining element 246 form a pocket having a volume that fits the circuit board 240 and holds in in a fixed position relative to the base 202. In another embodiment, the circuit board 240 snaps into the walls 250 of the lower retaining element 246. In another form, the circuit board 240 is attached to the lower retaining element 246 by an adhesive. The body 248 of the lower retaining element 246 may be shaped to allow the power pins 210A and/or pin socket 230 pass beyond the lower retaining element 246. In the embodiment shown, the body 248 includes recesses 252 to accommodate the power pins 210 and the associated hardware (including pin socket 230 and any wire connected thereto). The body 248 may define a plurality of holes 254 through which fasteners 256, such as screws, may extend. The fasteners 256 may be extended into complementary holes (not shown) of the central portion 258 of the plug 200 to attach the lower retaining element 246 to the plug 200.

In some embodiments, one or more of the communication pins 210B do not contact a circuit board 240, but instead include inner shafts 226 like the power pins 210A. The inner shafts 226 of these communication pins 210B may be received within a pin socket 230 which is electrically coupled with a wire extending to electronics such as a transceiver. A wire insulator 238 may be positioned over the pin socket 230 and the wire as described in relation to the power pins 210A above. In embodiments where all of the communication pins 210B extend to pin sockets 230, the plug 200 may not include a circuit board 240.

With reference to FIGS. 2, 4-5, 6C, 7C, and 8C, a plug boot 260 is placed around the shaft 216 of the pins 210A and 210B near the central portion 258 defining the holes 262 from which the pins 210A and 210B extend. As shown in FIG. 5, the plug boot 260 includes a base 264 and an annular wall 266, where the base 264 has a greater diameter than the annular wall 266. The annular wall 266 may extend along a portion of the length of the pins 210A and 210B. The plug boot 260 may be resilient and formed of a hard or soft rubber material to aid in sealing the pins 210A and 210B. For example, the plug boot 260 may inhibit fluid and debris from entering the holes 262 of the plug 200 and from reaching the seal 224 of the pins 210A and 210B. When the plug 200 is inserted into the socket 100, the annular wall 266 of the plug boot 260 extends into the socket boot 168 of the socket 100. This further aids in inhibiting fluid and debris from entering the holes 120 of the socket 100 and the holes 262 of the plug 200. The plug boot 260 is also an electrical insulator. When the plug boot 260 is in contact with the socket boot 168 of the socket 100, each pin 210A,B is electrically isolated from one another, even if fluid (e.g., salt water) is present within the internal cavity 136 of the socket or the cavity 208 of the plug 200.

In some embodiments, the pins 210A and 210B include threads disposed on an outer surface thereof that engage threads disposed within hole 262 of the plug 200 to attach the pins 210A and 210B to the plug 200.

In other embodiments, and as shown in FIGS. 2, 4-5, 6C, 7C, and 8C, the pins 210A and 210B may be slidingly inserted into the holes 262 of the plug 200. For instance, the inner shaft 226 and the base 212 of the power pins 210A and the base 212 of the communication pins 210B may be slidingly inserted into and removed from a hole 262 of the plug 200. The base 212 and/or the seal 224 of the pins 210A,B may be sized to hold the pins 210A,B within the holes 262 by a friction fit. Allowing the pins 210A and 210B to be slidably inserted into and removed from plug 200, without the use of threads, is advantageous as the pins 210A,B may be inserted into the holes 262 and forced to make contact with the pin socket 230 even if there is some debris within the hole 262 of the plug 200. In embodiments where threads are used, the threads may become damaged over time by the debris that enters hole 262 such that the pins 210A,B are no longer able to be threaded into the plug 200. Alternatively, the debris resting within the threads may prevent a pins 210A,B from being threaded to the plug 200 such that the pin 210A,B is unable to make electrical contact with the associated electrical contact of the plug 200.

An upper retaining element 268 attaches to the central portion 258 of the plug 200 to secure the pins 210A and 210B to the plug 200. The upper retaining element 268 includes a plurality of holes 270 through which the shaft portion 216 of each pin 210A and 210B and the corresponding plug boot 260 extends. The holes 270 may be sized smaller than the ribs 220 of the pins 210A and 210B and/or the base 264 of the plug boot 260 so that the pins 210A and 210B cannot pass through the holes 270. The upper retaining element further defines a plurality of holes 272 for receiving fasteners 273, such as screws, to secure the upper retaining element 268 to the plug 200 via complementary holes 274 of the central portion 258 of the plug 200. The upper retaining element 268 thus affixes the pins 210A and 210B to the central portion 258 of the plug 200. The upper retaining element 268 may hold the pins 210A and 210B such that they extend substantially parallel to the longitudinal axis of the plug 200. The plug boot 260 may aid to bias the pins 210A and 210B toward an orientation that is parallel to the longitudinal axis of the plug 200. The upper retaining element 268 and the plug boot 260 may allow the pins 210A and 210B to pivot slightly in all directions, because the shaft 216 of the pins 210A and 210B are not rigidly held within the plug boot 260 by the respective holes 270 of the upper retaining element 268. This slight pivoting aids in aligning the pins 210A and 210B with the socket boot 168 and outer sockets 146 of the pin connectors 142 of the socket 100 when inserting the plug 200 into the socket 100, especially if the plug 200 and socket 100 are brought into contact at an angle relative to one another. As one example, the pins 210A,B are affixed to the plug 200 by the upper retaining element 268 and the plug boot 260 such that the pins 210A,B are permitted to pivot in all directions about 3-5 degrees from an axis parallel to the longitudinal axis of the plug 200. This pivoting action advantageously reduces wear on exterior surfaces of the pins 210A,B and reduces strain on the pins and the retaining element 268.

The upper retaining element 268 may include raised platforms 276 and annular walls 278 about the holes 270.

The annular walls 278 and raised platforms 276 may guide fluid within the cavity 208 away from the pins 210A,B and towards the drainage holes 282 discussed below. The raised platforms 276 and annular walls 278 also increases the un-insulated surface distance between the pins 210A,B, relative to a flat surface. This advantageously reduces current leakage or "creepage" between positively charged pins 210A,B and negatively charged pins 210A,B and/or positively charged pins 210A,B and any grounded element of the connector 50.

The pins 210A and 210B may be replaced by removing the fasteners 273 to remove the upper retaining element 268. Once the upper retaining element 268 has been removed, the pins 210A and 210B may be pulled out of the plug 200 to be cleaned or replaced. In other embodiments, the pins 210A and 210B may have threads disposed on an outer surface thereof for engaging complementary threads of the holes 262 of the plug 200. The pins 210A and 210B may be threaded into the holes 262 to retain the pins 210A,B. In some embodiments where the pins 210A and 210B are attached to the plug 200 by threads, the upper retaining element 268 is not necessary.

With reference to FIGS. 1, 2, and 4 the base 202 of the plug 200 includes mounting holes 280 on opposite sides of the base 202. Fasteners such as a pin or other projection may be extended into the mounting holes 280 to secure the plug 200 to a structure, such as the structure of a watercraft. The plug 200 may be mounted to the structure such that the plug 200 pivots about the mounting hole 280. This may enable the plug 200 to pivot about the hole 280 to guide or align the plug 200 with the socket 100 when inserting the plug 200 into the socket 100. In one example, the plug 200 may be attached to the structure of the watercraft (e.g., the strut as in FIG. 9B) such that the plug 200 is able to pivot about the mounting holes 280 within a range of about 10-20 degrees. The structure of the watercraft may include stops extending therefrom, such as a rubber pad, configured to engage the base 202 of the plug 200 to inhibit the plug 200 from pivoting beyond a certain range. The stops may bias the plug 200 toward an orientation that is approximately within the center of its range of rotation about the mounting holes 280, e.g., an orientation that is perpendicular to a surface of the watercraft. As one example, two rubber stops extend upward from the top surface of the strut 308 to which the plug 200 is mounted. When the plug 200 is pivoted about the mounting holes 280 in a first direction, a portion of the bottom of the base 202 of the plug 200 engages a first of the rubber stops which prevents the plug 200 from pivoting further in the first direction. When the plug 200 is pivoted about the mounting holes 280 in a second direction, a portion of the bottom of the base 202 of the plug 200 engages a second of the rubber stops which prevents the plug 200 from pivoting further in the second direction. The pivoting action of the plug advantageously allows the plug to align with a corresponding socket, for example in the embodiments illustrated in FIGS. 10-14 where a container is latched onto the plug following a partially arcuate path. By allowing the plug to align, the pivoting action reduces strain on the connector bodies (the plug 204 and the socket 104) and on the pins 210A,B and pin connectors 142.

The insertion portion 204 of the plug 200 may include one or more drainage holes, slots, or passageways 282 extending from the cavity 208 to the exterior of the insertion portion 204. The drainage holes 282 may extend through the insertion portion 204 at the portion of the cavity 208 proximal to the base 202. This may be done in embodiments where the plug 200 is used in applications where the insertion portion 204 of the plug 200 will be inserted into the socket 100 in the vertical direction. This allows fluid within the cavity 208 to flow out the drainage holes 282 before insertion into the socket 100.

With reference to FIG. 5, the insertion portion 204 of the plug 200 may further include ribs 284 extending radially outward from the insertion portion 204. The ribs 284 define an upper and lower annular recesses or grooves 286, 288 that extend around the circumference of the insertion portion 204 that may receive upper and lower seals 290, 292 therein. The upper and lower seals 290, 292 may be, as an example, O-rings. The upper groove 286 and lower grooves 288 may be positioned along the insertion portion 204 such that each groove 286, 288 has a different diameter. In the embodiment shown, the upper groove 286 has a smaller diameter than the lower groove 288. The seals 290, 292 are positioned such that the upper seal 290 contacts the inner sealing surface 138 of the socket 100 and the lower seal 292 contacts the outer sealing surfaces 140 of the socket 100. During insertion of the plug 200 into the socket 100, the seals 290, 292 are brought into contact with the inner and outer sealing surfaces 138, 140 at approximately the same time. This reduces the amount of air that is trapped and compressed within the internal cavity 136 of the socket 100 as the plug 200 is inserted into the socket 100, reducing the amount of force required to fully insert the plug 200 into the socket 100, while providing two seals.

When the plug 200 is inserted into the socket 100, the seals 290, 292 of the plug 200 may be slid along the sealing surfaces 138, 140 of the socket 100 to fully insert the plug 200. The plug 200 acts as a piston, which compresses air that is trapped within the internal cavity 136 of the socket 100 and the cavity 208, increasing the pressure within the internal cavity 136 and cavity 208. Having a pressure greater than atmospheric pressure within the cavities 136, 208 may aid in preventing fluid from entering the internal cavity 136 and cavity 208, although this benefit must be balanced against the need to make it relatively easy to insert the plug 200 into the socket 100.

In the illustrated embodiment, the insertion portion 204 further includes an annular groove 294 on a portion of the insertion portion above the seals 290, 292. This annular groove 294 creates more volume within the internal cavity 136 of the socket 100 and cavity 208 of the plug 200 when the seals 290, 292 engage the inner and outer sealing surface 138, 140. Having a greater volume for air within the sealed compartment may make insertion of the plug 200 into the socket 100 easier as the greater volume reduces the pressure increase caused by a given insertion distance within the sealed compartment and therefore reduces a force required to compress the air.

When connecting the socket 100 and the plug 200, the plug 200 may be aligned with the socket 100. For example, the tapered tip 206 of the insertion portion 204 of the plug 200 may be positioned within the internal cavity 136 of the socket. The plug 200 and the socket 100 may be forced together until the pins 210A and 210B are brought into contact with the openings of socket boots 168 of the socket 100. As the plug 200 is inserted into the socket 100, the pins 210A and 210B may enter the socket boots 168 and into the outer socket 146 of the pin connectors 142 of the socket 100. The rounded tips 218 of the pins 210A and 210B may aid to guide and align the pins 210A and 210B into the socket boots 168 and the outer sockets 146. The pins 210A and 210B may pivot slightly, as permitted by the upper retaining element 268. This may aid in aligning the pins 210A and 210B with the socket boots 168 and the outer sockets 146, especially when the pins 210A and 210B are slightly misaligned with the socket boots 168 upon insertion or when the plug 200 is inserted into the socket 100 at a slight angle. The plug 200 is urged into the socket 100 until the seals 290, 292 are brought into contact with the sealing surfaces 138, 140 of the socket 100. The plug 200 may be further inserted into the socket 100 until the plug boot 260 of the plug 200 is received within the socket boot 168 of the socket 100 to electrically and fluidically isolate each of the pins 210A,B from one another.

Figure 9A:
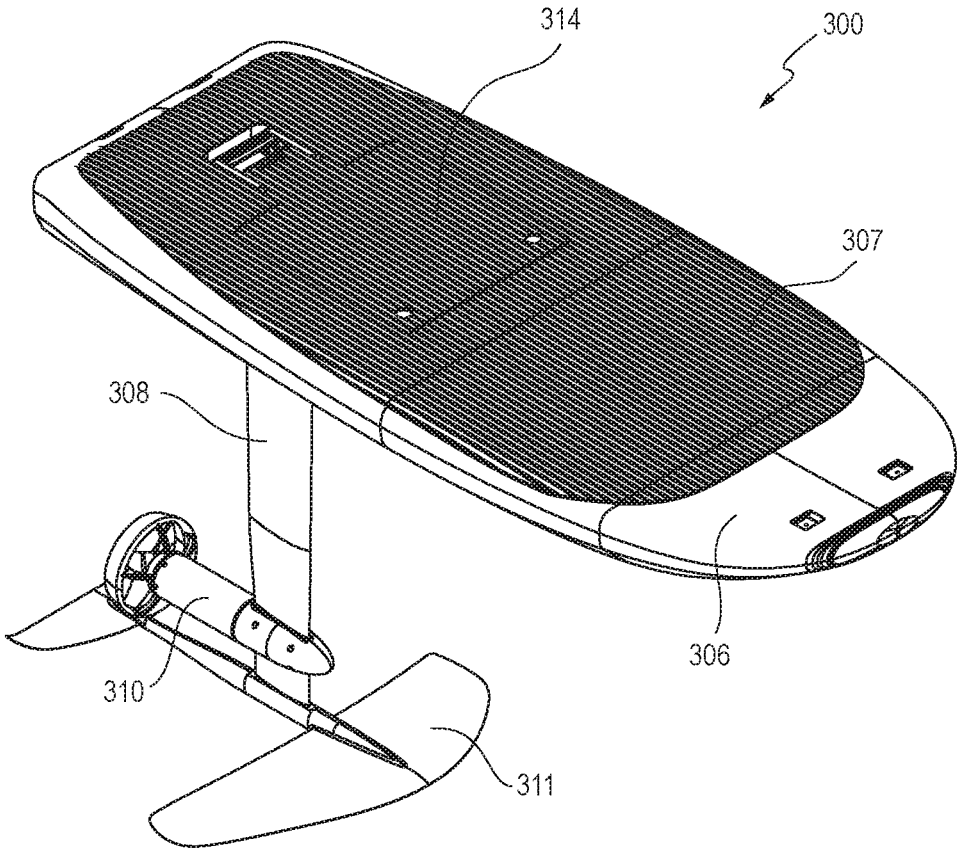
FIG. 9A shows a perspective view of an example application of the connector of FIG. 1 used to removably connect a container to a watercraft.
Figure 9B:
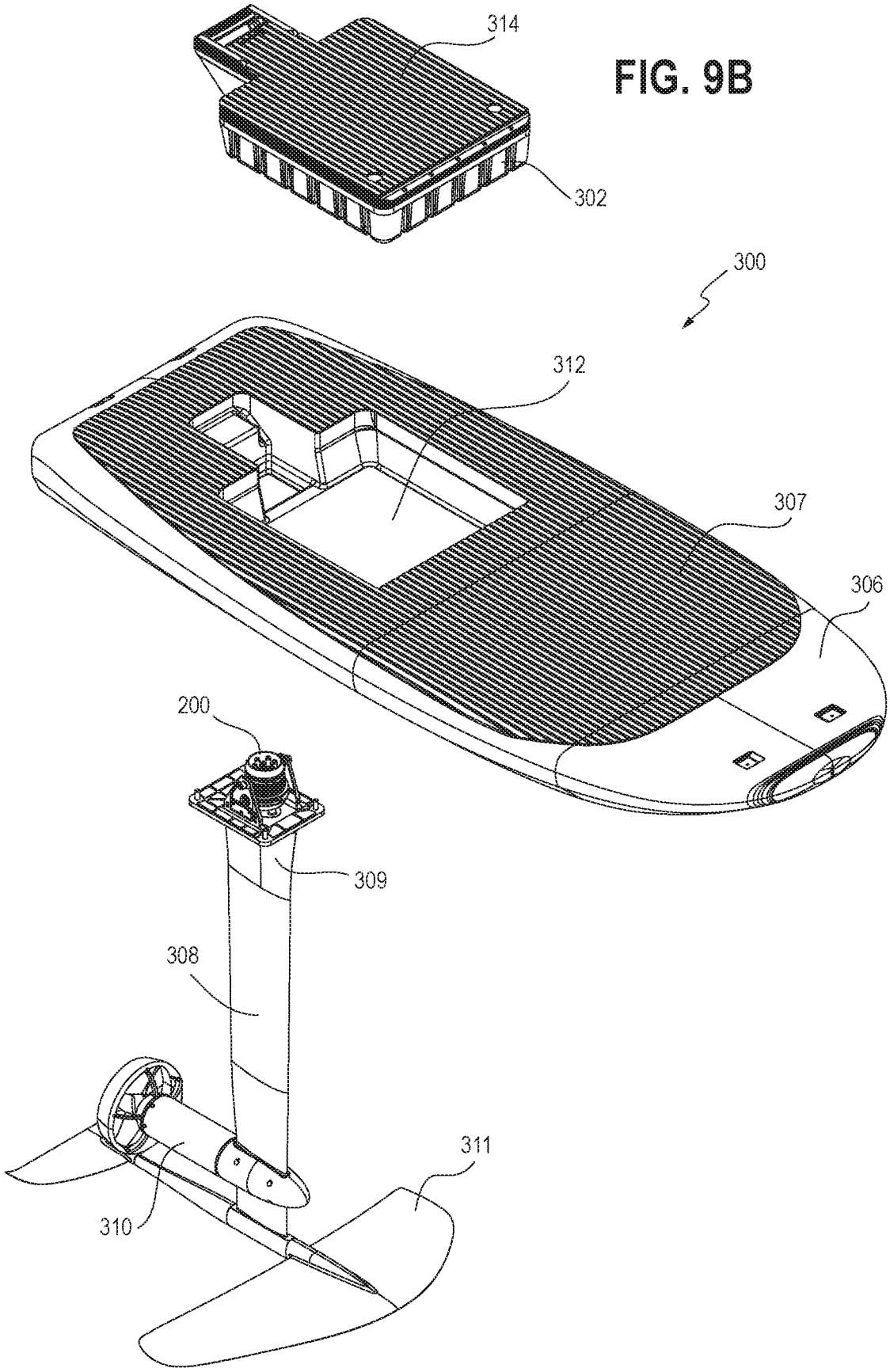
FIG. 9B shows an exploded view of the example watercraft of FIG. 9A.
Figure 11:
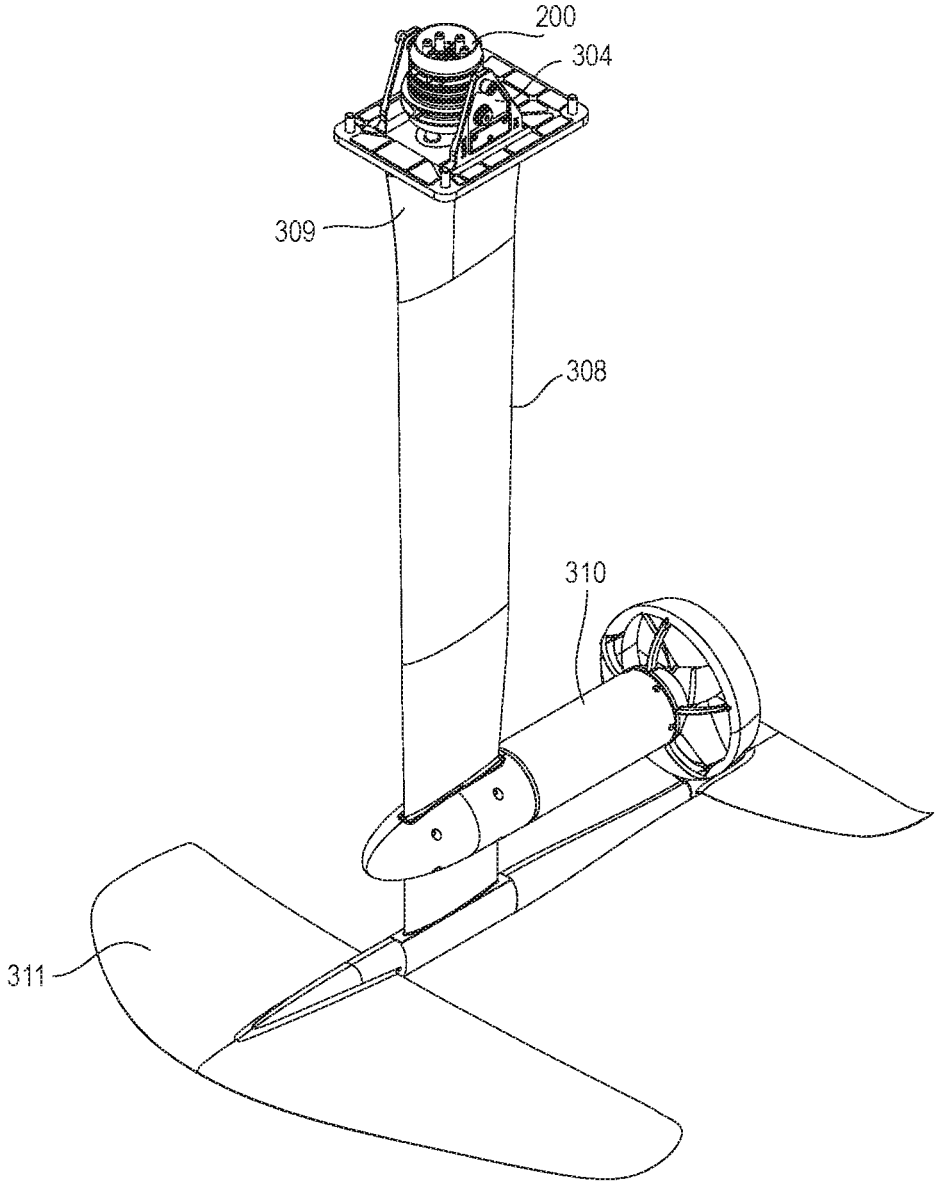
FIG. 11 shows a top perspective view of a strut of a watercraft device including the plug of the connector of FIG. 1.

With reference to FIGS. 9-11, an example application where the connector 50 is used in a watercraft 300 is shown. As shown in the example application of FIGS. 9A-B, the watercraft may be a hydrofoiling surfboard device 300 including a board or flotation portion 306, a strut 308, a propulsion unit 310 including an electric motor and propeller attached to the strut 308, and hydrofoils 311 attached to the strut 308. The watercraft 300 is similar in some aspects to the jetfoiler devices described in U.S. Pat. No. 10,597,118 and U.S. patent application Ser. No. 16/543,447, the contents of which are incorporated by reference herein in their entirety. In the illustrated example, the board 306 is made of a material or is sealed such that it has a sufficiently low density that it floats in water or is buoyant. The board 306 may prevent the watercraft 300 from sinking where the other components of the watercraft do not otherwise float. The upper surface of the flotation portion 306 is a deck 307 that may support a rider or user of the watercraft 300.

The watercraft illustrated in FIGS. 9A-9B differs from previously described electric hydrofoiling surfboards such as the jetfoiler device. Prior devices utilized a water-tight compartment to enclose batteries and other sensitive electronics. In contrast, the watercraft 300 includes an open cavity 312 within the flotation portion 306 sized to receive the container 302. In the illustrated device, the upper surface 314 of the container 302 forms a portion of the deck 307 of the watercraft 300 when inserted into the cavity 312. For example, the upper surface 314 of the container 302 is substantially coplanar with the top surface or deck 307 of the flotation portion 306, such that the top surface of the container 302 effectively forms a part of the deck 307 or the top surface of the flotation portion 307. A person standing on the deck 307 should notice little difference between the upper surface 314 of the container 302 and the deck 307 of the flotation portion 306 when, for example, their foot is partially on the deck 307 of the flotation portion 306 and partially on the upper surface 314 surface of the container 302. The container 302 thus may be formed of a resilient material, such as a plastic or carbon composite to support a rider. The disclosed design thus advantageously eliminates the need for a separate watertight compartment.

Further, in the illustrated device 300, the container 302 is rigidly coupled to a strut 308. This approach avoids several engineering challenges present in prior devices, where batteries were stowed in a water-tight compartment and electrically connected to a motor affixed to the strut via flexible cables running through the board. The present design advantageously eliminates the need for a cable harness within the board 306 and therefore simplifies manufacture of the board. Instead of running through cables within the board 306, electrical power from a battery or other power source and communication signals from a transceiver are transmitted directly from the container 302 through the socket 100 to the plug 200 and through wires within the strut 308. A motor and transceiver in the propulsion unit 310 receives the necessary electrical power and communication signals.

In addition, the disclosed design reduces the need for structural components and mechanical connections integrated within the board 306, which separately simplifies manufacture of the board. Prior devices required substantial layup around structural elements such that a board could connect first to the strut and second to form a watertight compartment for a battery. In the design illustrated in FIGS. 9A-9B, the flotation portion 306 is sandwiched between the upper portion 309 of the strut 308 and the container 302. This distributes stress throughout a larger area of the board and therefore reduces the need for carbon fiber or fiberglass layup to incorporate metallic or other rigid structural members within the board. Further, the disclosed design reduces the need for close dimensional tolerances in the board 306. The illustrated design is also advantageous for disassembly and transport of the watercraft 300. For transport of the device 300 detaching the strut 308 from the board 306 is desirable. Many quick-release designs, however, require incorporating tight dimensional tolerances in the board. In the disclosed design, the container 302 is quickly and securely connected directly to the rigid structures of the strut 308, which may compress the board 306 to form a tight connection between the strut 308, the container 302, and the board 306.

Although not illustrated, other embodiments incorporate a cavity in a bottom surface or rear surface of the flotation portion 306. Although these bottom or rear loading embodiments beneficially reduce the need for a cable harness within the flotation portion 306, they do not necessarily provide structural advantages described above. Other aspects of the illustrated watercraft 300 remain the substantially the same, specifically including the manner in which the connector 50 directly connects the container 302 to the strut 308. Preferably in these embodiments, an outside surface of the container is substantially coplanar with the outside surface of the flotation portion 306, which additionally serves to reduce complexity in the flotation portion 306 by eliminating the need for a compartment door hatch.

The advantages of the disclosed device 300 are facilitated in part by the design of the connector 50. In the device 300 illustrated in FIGS. 9A-14D, a socket 100, as described above, is connected to an end of a container 302 housing electronics and a plug 200 is connected to the strut 308 of a watercraft 300. In other examples, the socket 100 may be attached to the watercraft 300 with the plug 200 attached to the container 302.

The watercraft may also be a boat, an electric surfboard, a jet ski, or any device for use on the water that includes a battery and/or other electrical equipment, with similar benefits. While the example application above shows the container 302 within the deck 307 of the hydrofoiling device, the container 302 may similarly be inserted into the deck of another watercraft 300, for example, a boat. In other examples, the container 302 similarly attaches to another surface of the watercraft 300, for example, the upper surface 302 forms a portion of an internal wall or the exterior surface of the watercraft (e.g., a jetski). In some embodiments, the upper surface 314 is not planar but matches the contour of the surface to which it is attached. For example, where the container 302 is attached to a cavity in a curved surface, the upper surface 314 of the container 302 may match the curvature of the curved surface, such that the presence of the container 302 is discrete.

FIGS. 10A and 10B provide detail views of the container 302. The container 302 is a watertight container that may house a rechargeable battery and associated safety features. This may include, for example, a solid-state fuse or contactor (not shown) that disconnects the main power pins of the connector when it is disconnected from the watercraft 300. In one example, the fuse disconnects when communication signals are not present. Other mechanisms may also be used, including a pin interlock or proximity sensor relying upon a magnet or other means as would be known to a person having ordinary skill in the art. The container 302 may also house battery management electronics, a CAN-bus or other transceiver, motor control circuitry, GNSS circuitry, or the like. In the embodiment shown, the socket 100 is attached to an end 322 of the container 302. The plug 200 is attached to the upper end 309 of the strut 308. The pins 210A,B of the plug 200 are electrically coupled to an electric motor (e.g., of the propulsion unit 310) and an electronic speed controller attached to the strut 308. The pins 210A,B of the plug 200 are configured to contact the pin connectors 142 of the socket 100 when the plug 200 is inserted into the socket 100 of the container 302. The pin connectors 142 are electrically coupled to the battery and transceiver housed within the container 302.

In use, the container 302 may be positioned within the cavity 312 of the watercraft such that the socket 100 receives the plug 200. This provides one or more electrical pathways between the container 302 and the strut 308. An electrical pathway may extend from the battery within the container 302 to the electric motor of the propulsion unit 310 attached to the strut 308. Another electrical pathway may extend between the transceiver of the container 302 and a transceiver associated with an electronic speed controller attached to or enclosed within the strut 308. In one form, the plug 200 is attached via holes 280 such that the plug 200 may pivot slightly to aid in inserting the plug 200 into the socket 100. When the battery of the container 302 needs to be removed (e.g., to be recharged or replaced) the container 302 is removed from the cavity 312 of the watercraft 300, disconnecting the socket 100 from the plug 100. Because both the socket 100 and the plug 200 include seals to prevent fluid from passing through the socket 100 or plug 200 even when the plug 200 is not inserted into the socket 100, the container 302 may be removed even in wet environments, for example, when the watercraft 300 is still within the water.

Figure 12A:
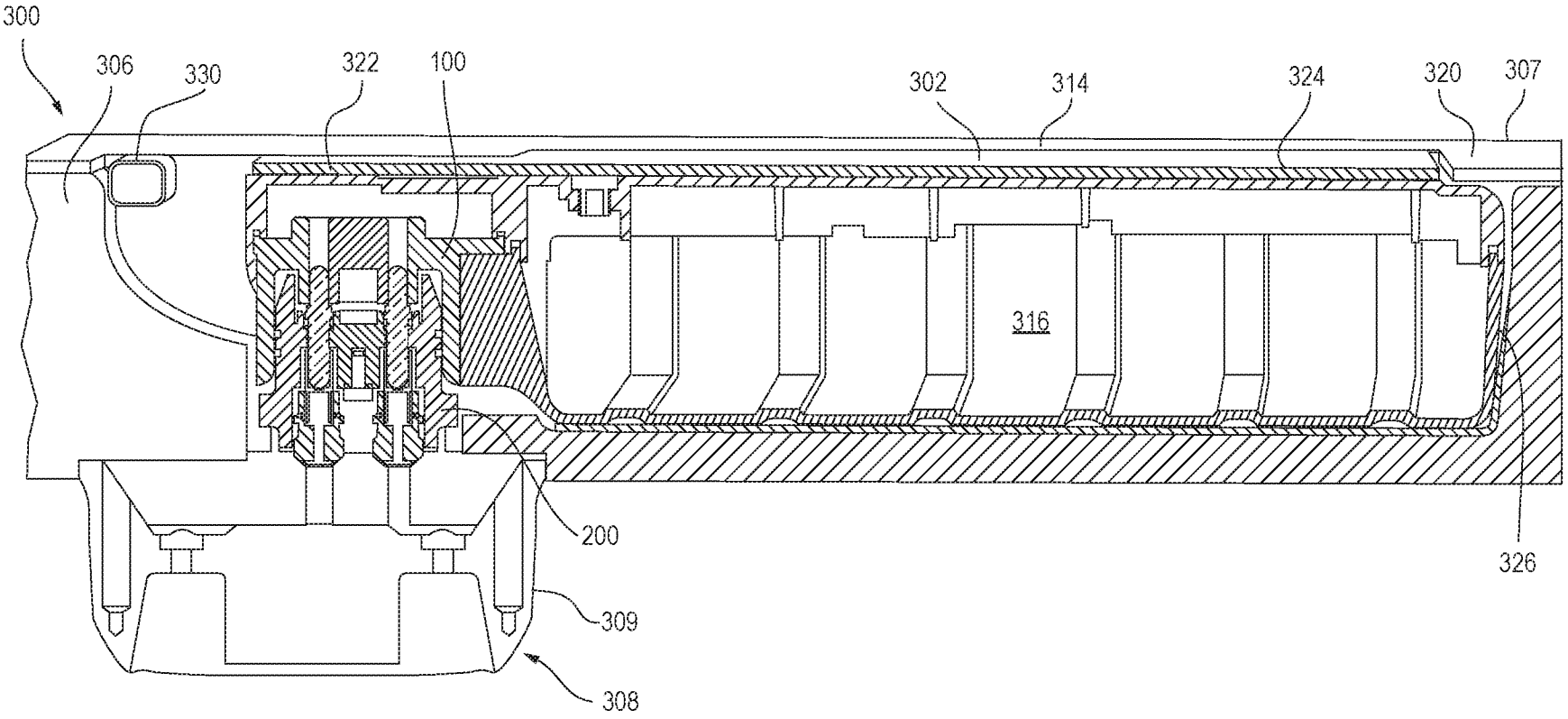
FIGS. 12A-D show side cross-section views of the container of FIGS. 10A-B being progressively removed from a watercraft.
Figure 12B:
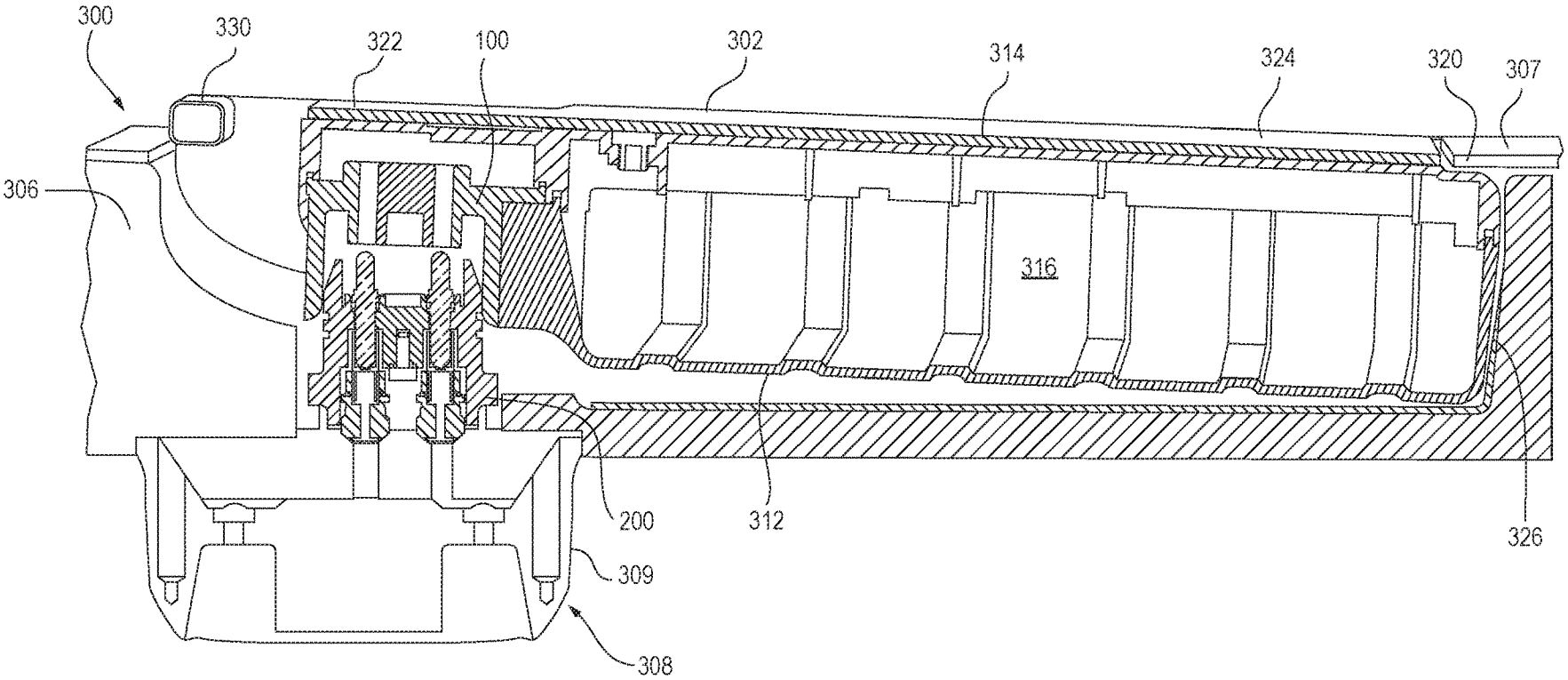
Figure 12C:
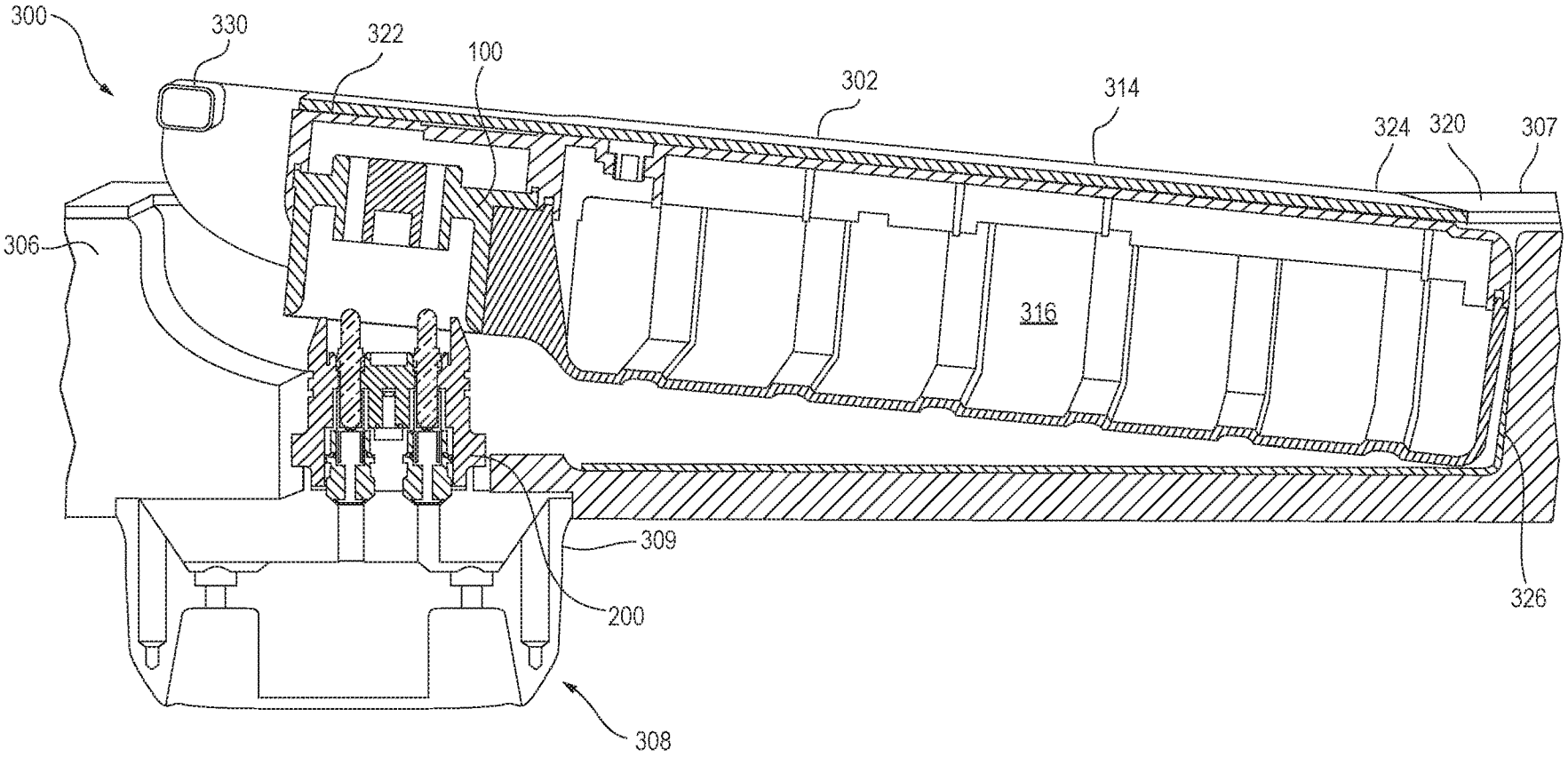
Figure 12D:
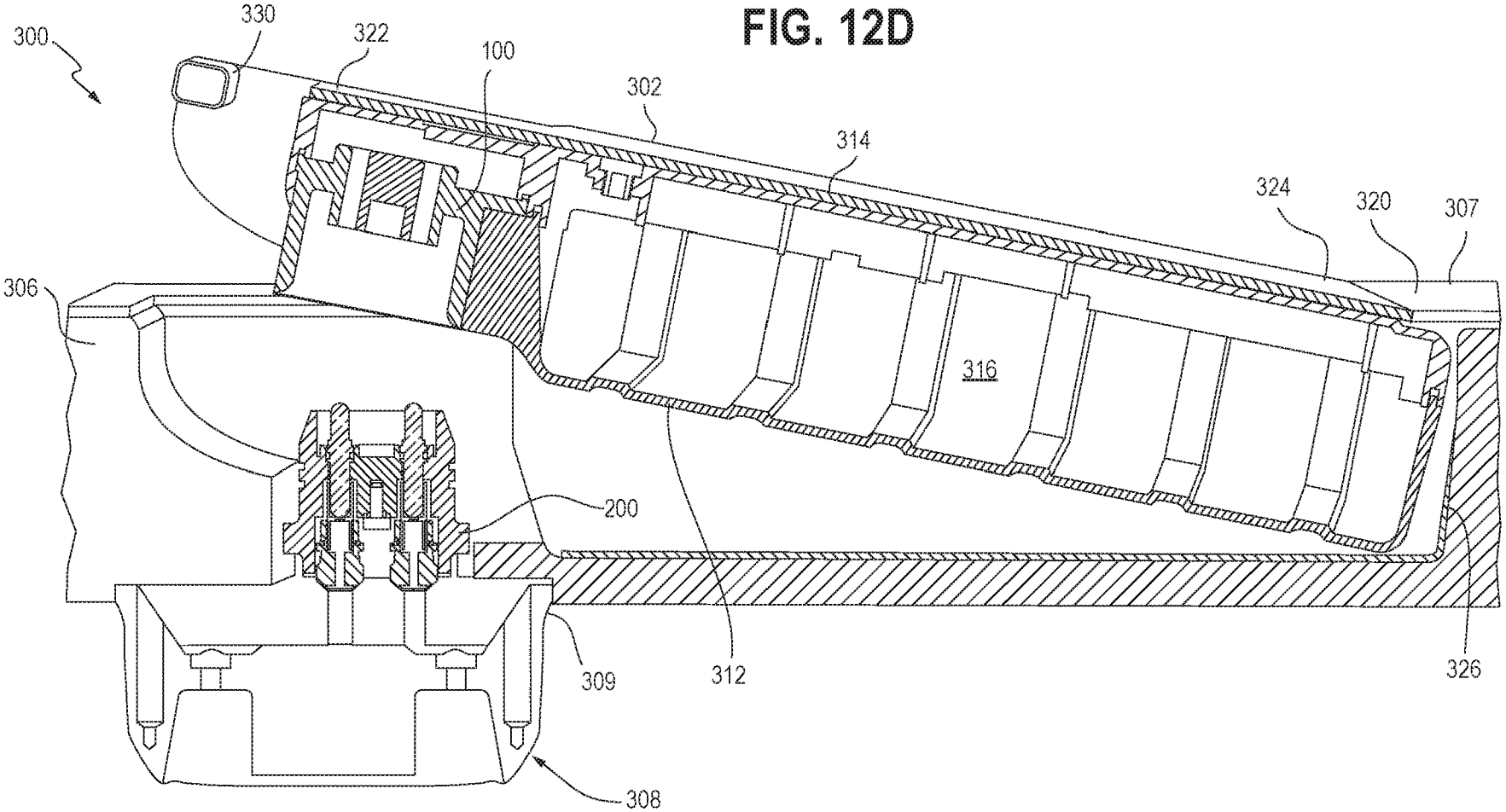

With reference now to FIGS. 12A-D, the images show container 302 being removed according to an embodiment. As shown, the container 302 includes a cavity 316 for housing one or more electrical components as described above. The socket 100 is attached at an end 322 of the container 302, with the internal cavity 136 of the socket 100 facing downward or away from the upper surface 314 of the container 302. In FIG. 12A, the plug 200 of the watercraft 300 is shown fully inserted into the socket 100. To remove the socket 100 from the plug 200, the end 322 of the container 302 may be moved in the upward direction, away from the plug 200 and out of the cavity 312 of the watercraft 300. With reference to FIGS. 12B-D the end 322 of the container 302 having the socket 100 is shown progressively moving away from the plug 200. The container 302 is shown pivoting about an end 324 of the container opposite the socket 100, until the socket 100 is no longer in contact with the plug 200 as shown in FIG. 12D. The container 302 may then be removed from the cavity 312 of the watercraft 300.

To insert the container 302 into the cavity 312 of the watercraft 300 and connect the plug 200 of the watercraft 300 to the socket 100 of the container 302, the steps for removing the container 302 may be reversed. With reference to FIG. 12D, the end 324 of the container 302 opposite the socket 100 may be positioned within the cavity 312. The end 324 may be brought near or into contact with the end 326 of the cavity 312 opposite the plug 200. Then, as shown progressively from FIG. 12C to FIG. 12A, the socket end 322 of the container is pivoted about the end 324 opposite the socket 100 to bring the socket 100 into contact with the plug 200 of the watercraft 300. As the socket 100 contacts the plug 200, the plug 200 may pivot about holes 280 to align with the receptacle portion 104 of the socket 100. The pins 210A and 210B of the plug 200 may also pivot or move slightly to align with the socket boots 168 and the outer socket 146 of the pin connectors 142 of the socket 100. The end 322 of the container 302 may be forced downward and into the cavity 312 until the insertion portion 204 of the plug 200 is fully received within the receptacle portion 104 of the socket 100. This may occur when the upper surface 314 of the container 302 is horizontal and/or substantially coplanar with the deck 307 of the watercraft 300.

As shown in FIGS. 12A-D, the container 302 includes a handle 330 attached to the end 322 of the container 302 including the socket 100. The handle 330 may be used to pivot the container 302 about the end 324 opposite the socket 100 to connect and disconnect the socket 100 from the plug 200. The handle 330 may provide additional leverage to the user in inserting or extracting the container 302 from the cavity 312 of the watercraft 300.

In some embodiments, the deck 307 of the watercraft 300 may include a tongue 320 that extends over the upper surface of the cavity 312. The end 324 of the container opposite the socket 100 may extend underneath the tongue 320 when fully inserted into the cavity 312. During insertion, when the end 324 of the container is positioned within the cavity, a portion of the upper surface 314 at end 324 of the container 302 may be brought into contact with the tongue 320. For example, an installer may slide the container 302 along the cavity 312 until the upper surface 314 contacts the tongue 320. As the end 322 of the container 302 including the socket 100 is pivoted toward the plug 200 and into the cavity 312, the container 302 may pivot about the point of contact between the container 302 and the tongue 320. As the end 322 of the container 302 nears the plug 200, the bottom surface of the container 302 may slide or translate along the bottom of the cavity 312 in the direction opposite the plug 200. Once the socket 100 contacts or engages the plug 200, the container 302 no longer slides or translates, but rotates about the point of contact between the container 302 and the bottom surface of the cavity 312 until the plug 200 is fully inserted into the socket 100. This design, where the translation of the container 302 occurs before the socket 100 engages the plug 200, reduces the amount of stress and strain applied to the plug 200 in connecting the socket 100 to the plug 200. Since the container 302 is substantially only rotating about the point of contact of the container 302 and the bottom surface when the plug 200 and the socket 100 interconnect, the plug 200 only needs to pivot slightly to align with the socket 100. Further, the lateral forces on the plug 200 are minimized because, at the point where the plug 200 contacts the socket 100, the container 302 lacks freedom to translate within the cavity 312. This may reduce the risk of damage to the plug 200 during insertion and removal of the container 302.

The distance between the tongue 320 and the bottom of the cavity 312 may be the same or slightly smaller than the height of the container 302. Thus, when the container 302 is positioned within the cavity 312 with a portion of the container 302 between the tongue 320 and the bottom surface of the cavity 312, the end 324 of the container 302 is held firmly in place by watercraft 300, being slightly compressed by the tongue 320 and the bottom of the cavity 312. In one embodiment, the container 302 may include resilient strips designed to compress as the container 302 locks into place within the cavity. These resilient components advantageously reduce the need for tight tolerances when forming the cavity 312 within the board 306.

In yet another embodiment, shown in FIGS. 13A-D and 14A-D, the handle 330 is rotatably attached to the container 302. The handle 330 includes a gripping portion 332 having two ends, each end attached to an arm 334. The arm 334 extends from the gripping portion 332 to the attachment point 336 at the end of the arm 334 opposite the gripping portion 332. The arm 334 is rotatably attached to the container 302 by a fastener, allowing the gripping portion 332 of the handle 332 to rotate about the attachment point 336. Each arm 334 further includes a slot 338 for receiving pins 340 affixed to the upper end 309 of the strut 308 of the watercraft 300. As shown the pins 340 extend from the attachment structure 342 at the upper end 309 of the strut 308 to which the plug 200 is attached. In other embodiments, the pins 340 may protrude from a surface of the cavity 312 or the plug 200. Each slot 338 include a mouth 344 for receiving the pin 340. The slots 338 include a lower cam surface 346 and an upper cam surface 348 that the pins 340 engage as the pins 340 move along the slot 338. The lower cam surface 346 includes an inner detent 350 and an outer detent 352 for receiving the pin 340. When the pin 340 is within a detent 350, 352 the pin 340, the handle 330 does not move substantially relative to the pin 340 without the application of force on the handle 330.

Figure 13A:
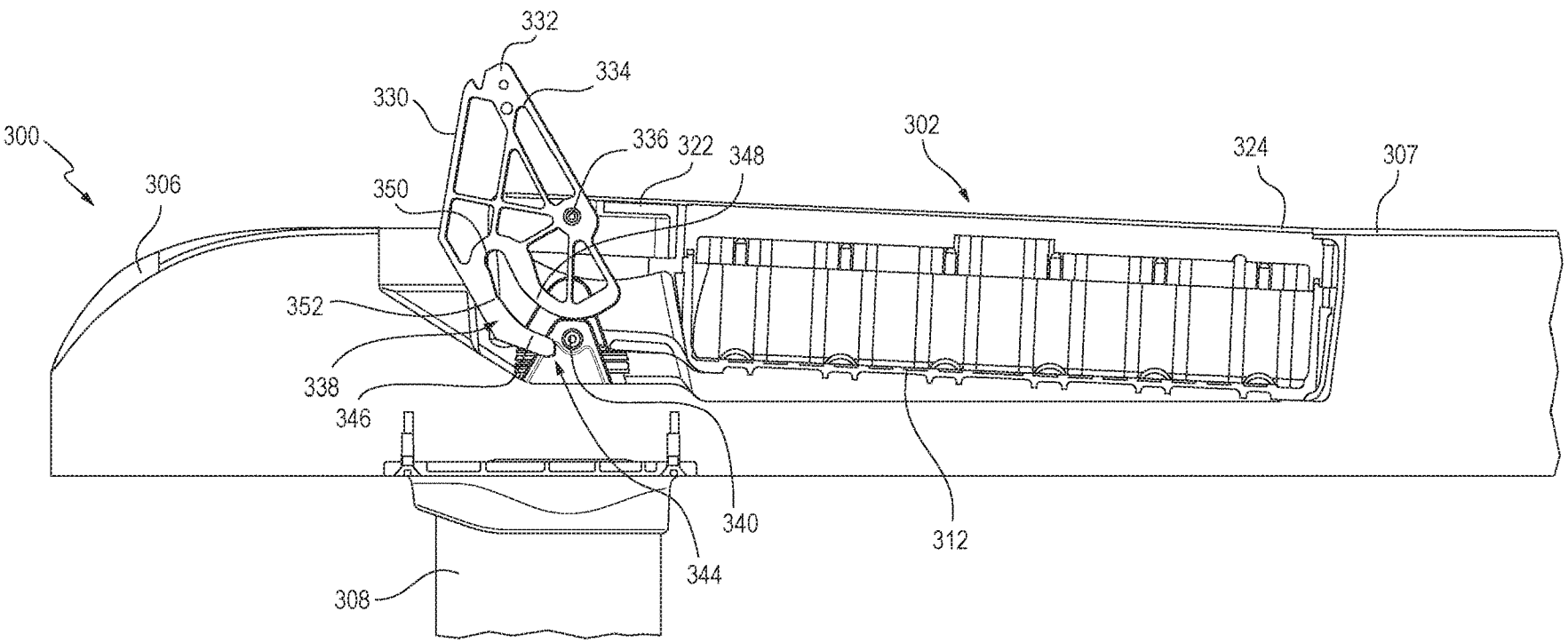
FIGS. 13A-D show a side partial cutaway view of a container including a handle used to attach the socket of the container to the plug of the watercraft.
Figure 13B:
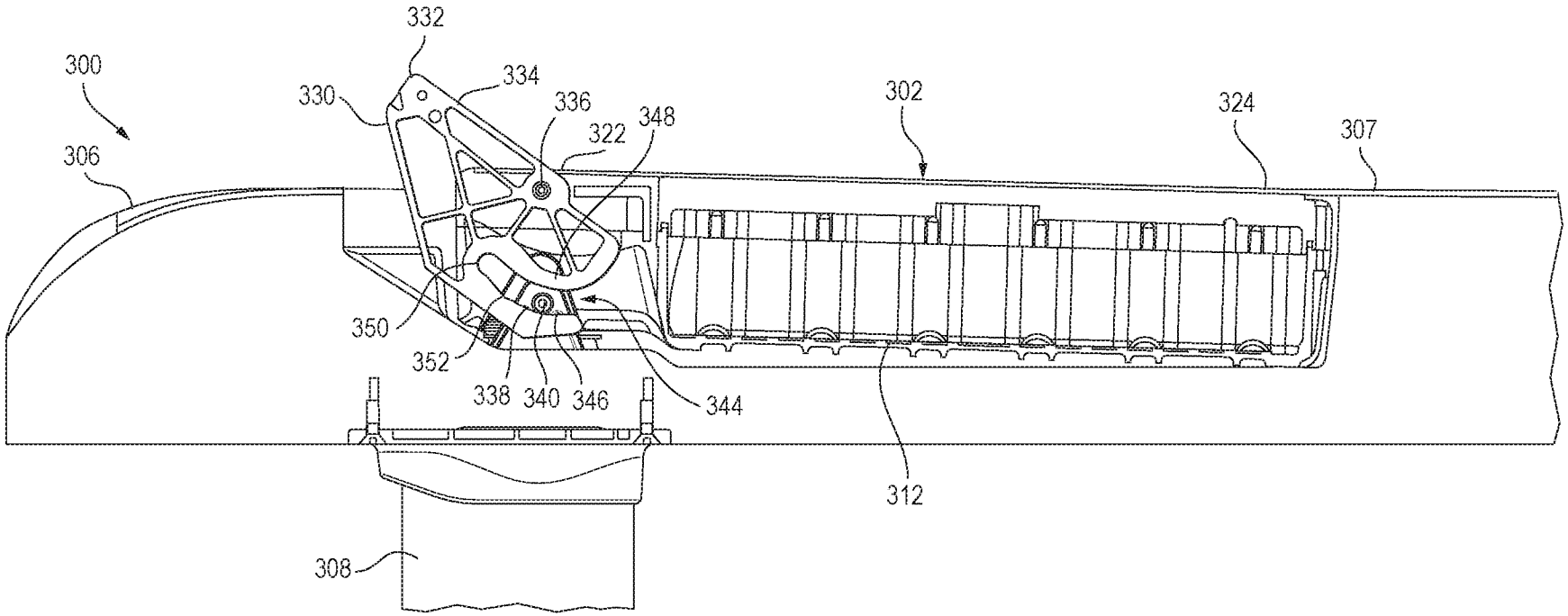
Figure 13C:
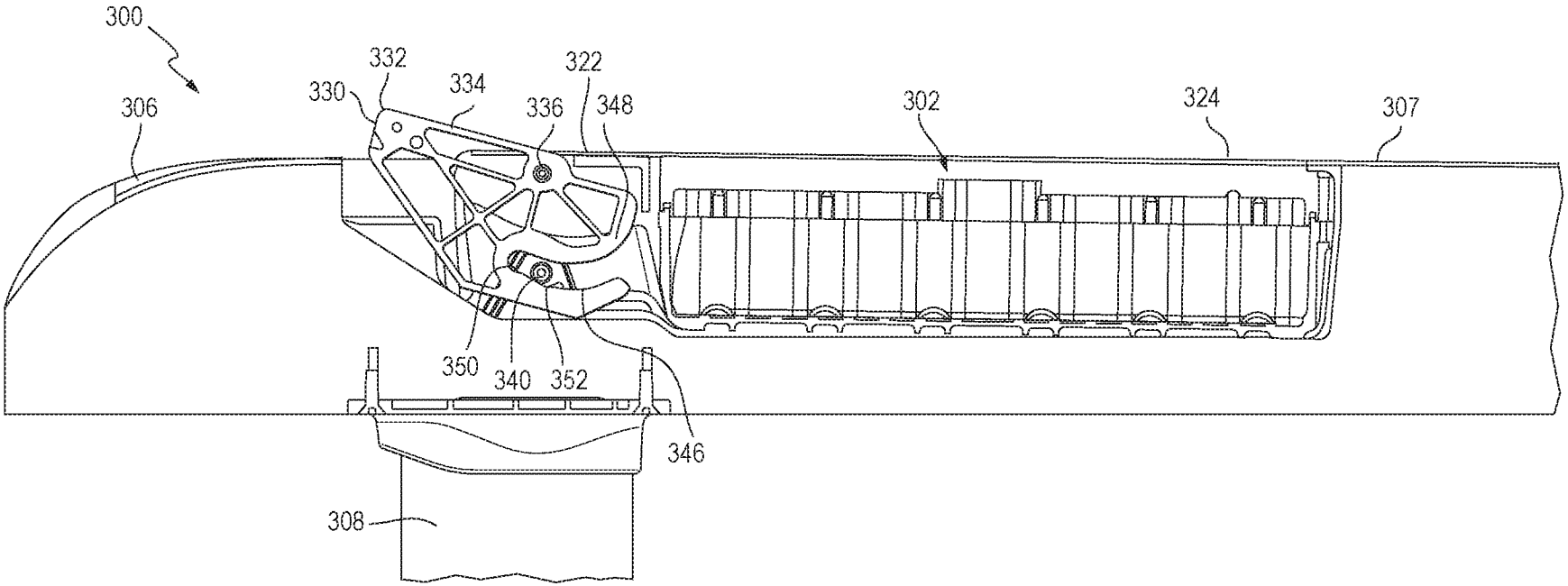
Figure 13D:
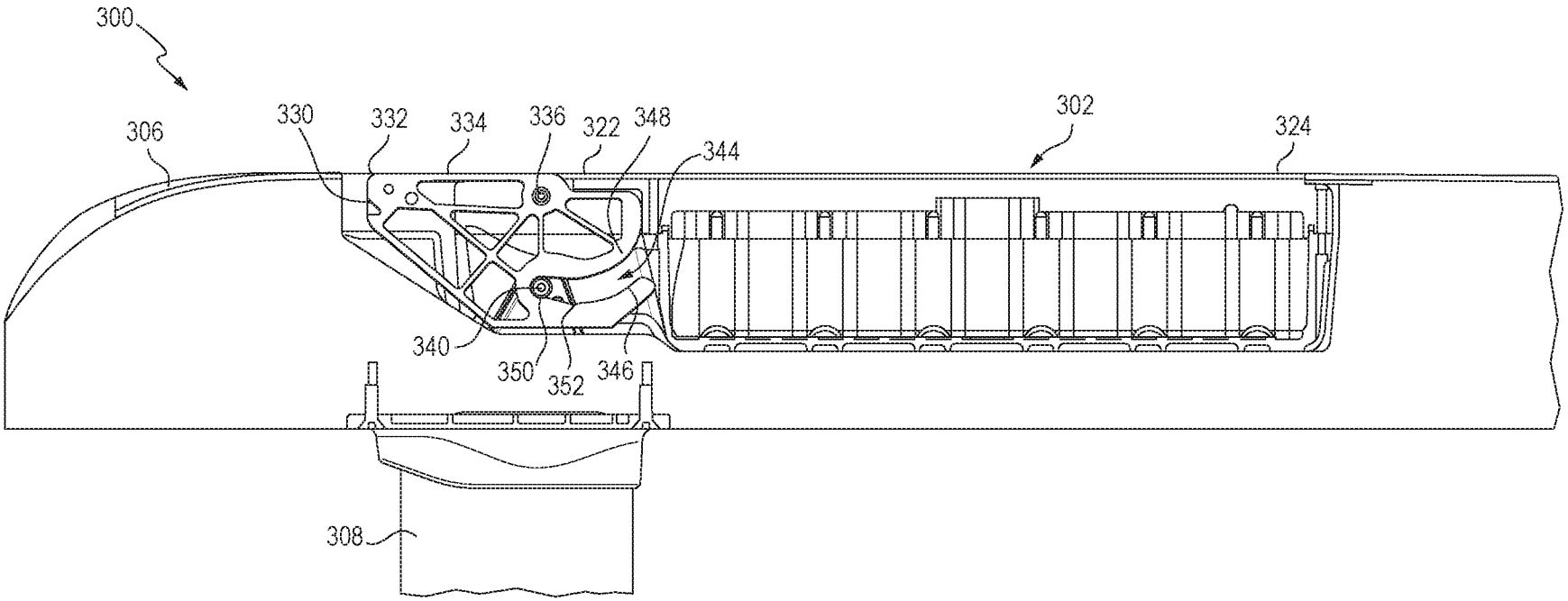
Figure 14A:
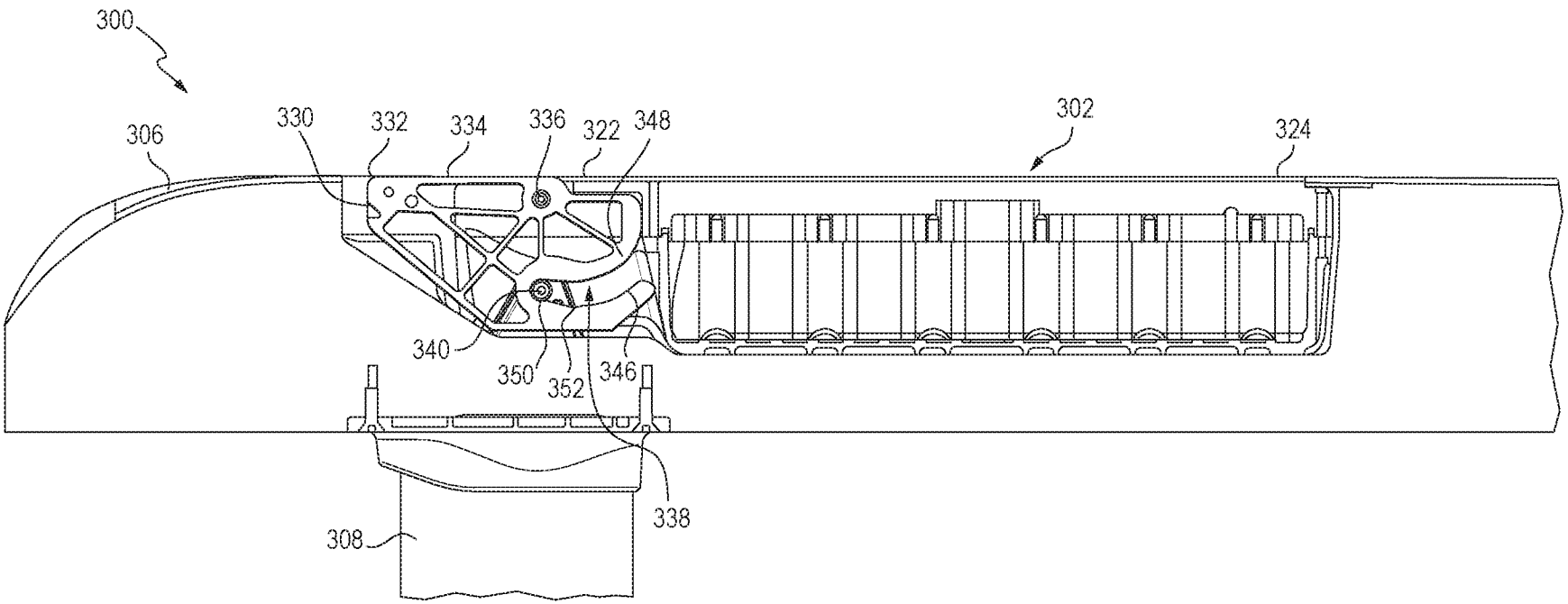
FIGS. 14A-D show a side partial cutaway view of a container including a handle used to remove the socket of the container from the plug of the watercraft.
Figure 14B:
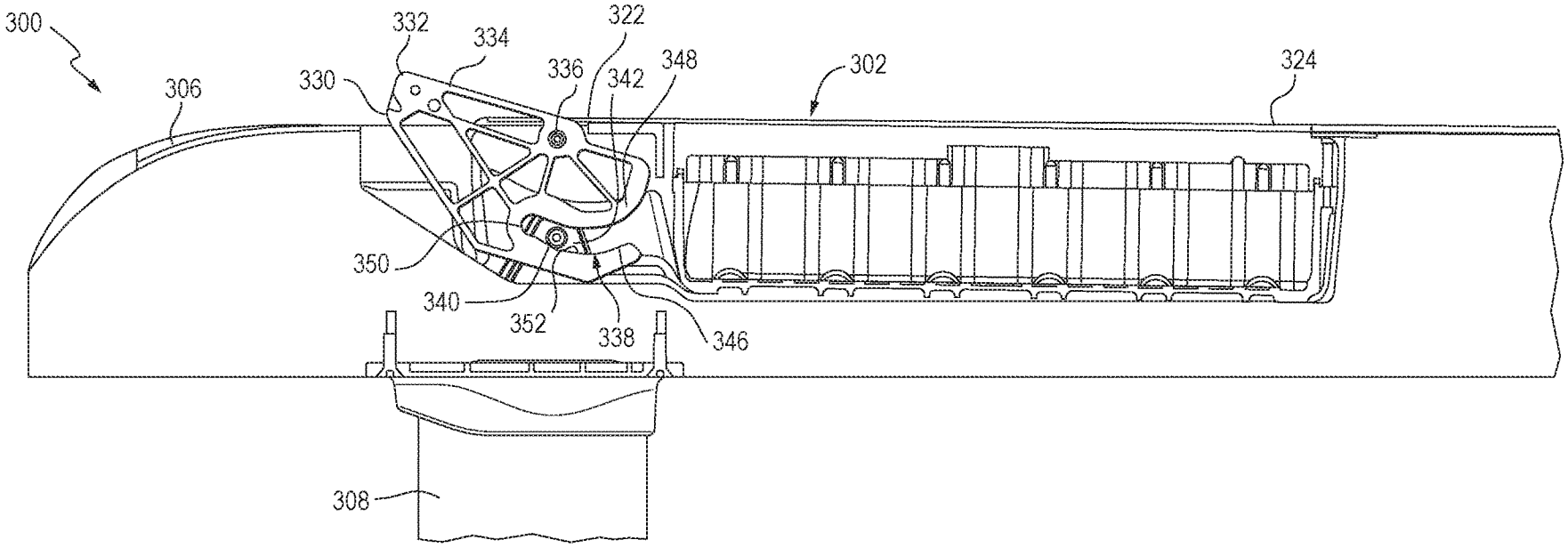
Figure 14C:
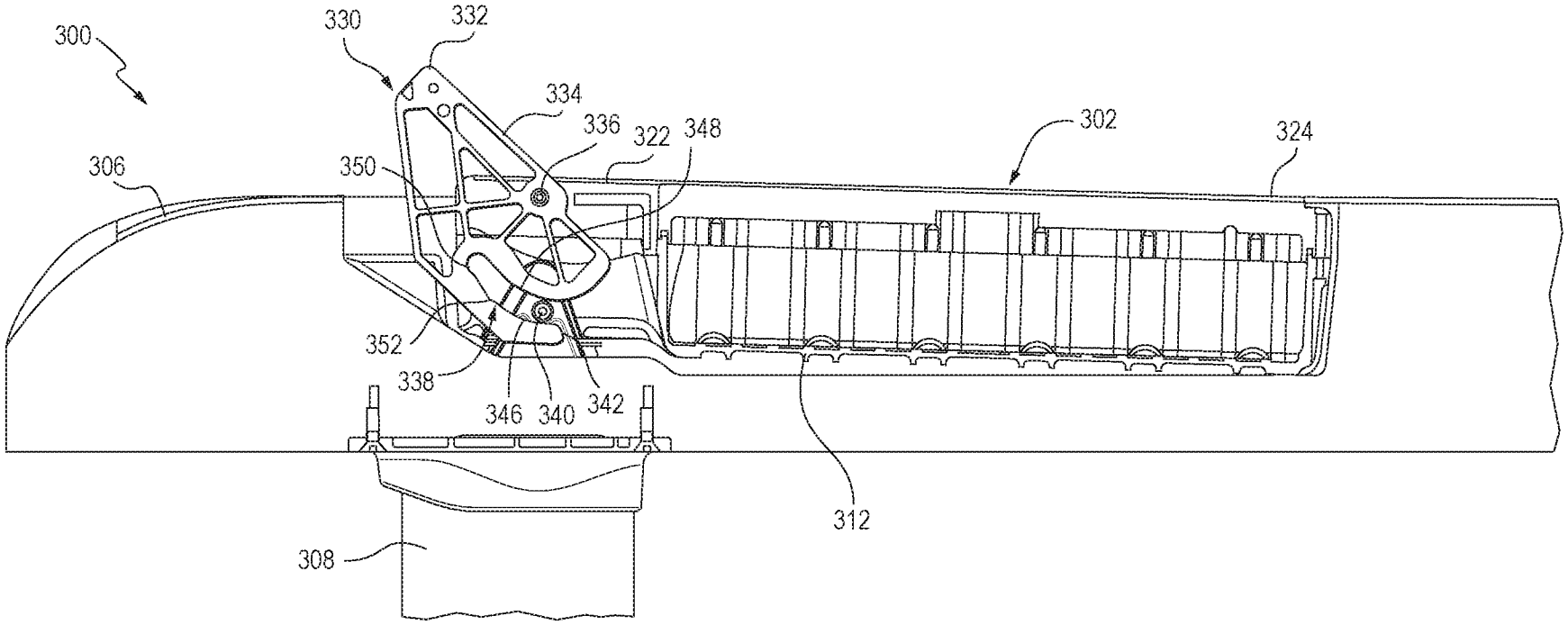
Figure 14D:
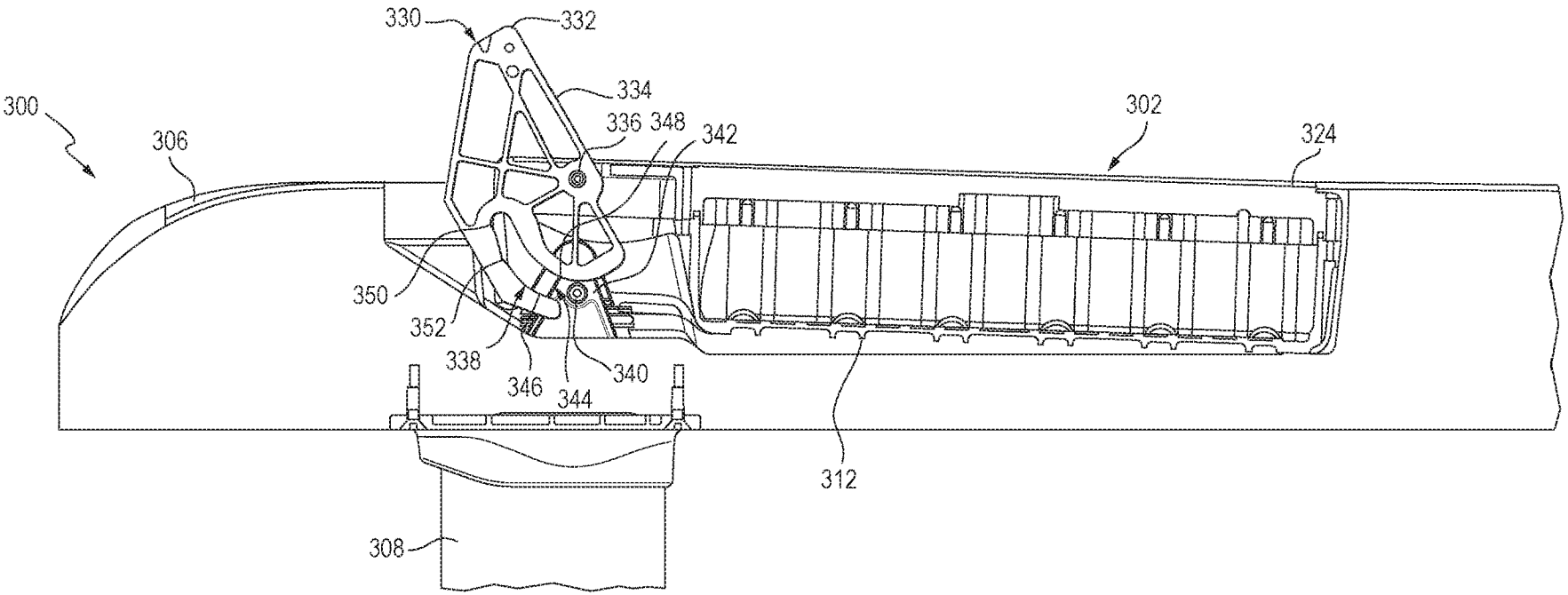

In operation, when inserting the container 302, the end 324 of the container 302 opposite the socket 100 is positioned within the cavity 312 of the watercraft 300, for example as described above in regard to FIGS. 12A-D. As the socket 100 of the container 302 is pivoted towards the plug 200, the handle 330 is in an upward position, causing the mouths 344 of the slots 338 to be near pins 340. The handle 330 may be rotated downward, causing the pins 340 to enter the slots 338 via the mouths 344, for example, as shown in FIG. 13B. An installer may rotate the handle 330 by moving the gripping portion 332 about the attachment point 336. The pins 340 may slide along the lower cam surface 346 of the slot 338 during insertion. The handle 330 is further rotated about the attachment point 336, causing the lower cam surface 346 of the handle 332 to apply a force to the pin 340 and move the plug 200 further into the slot 100. As the pin 340 is moved along the lower cam surface 346 by rotation of the handle 330, the pin 340 enters the outer detent 352, as shown in FIG. 13C. To move the pin 340 beyond the outer detent 350 may require increased force to cause the plug 200 to be fully inserted into the socket 100 of the container 302. Providing the outer detent 352 along the slot 338 provides tactile feedback to the installer, providing the opportunity to ensure that the pins 210A,B of the plug are properly aligned with the pin connectors 142 of the socket 100 before fully inserting the plug 200 into the socket 100. With this tactile feedback, the installer may be able to determine whether the plug 200 is properly entering the socket 100 or whether something appears to be misaligned. To fully insert the plug 200 into the socket 100, an additional downward force must be applied to the gripping portion 332 of the handle 330 to cause the pin 340 to move from the outer detent 352 to the inner detent 350 of the slot 338 as shown in FIG. 13D. Once the pin 340 is resting in the inner detent 350 of the slot 338, the plug 200 is fully inserted within the socket 100. The gripping portion 332 and a top surface of the arms 334 may be substantially horizontal and even co-planar with the deck 307 of the watercraft 300. The resilient components within the connector 50 (e.g., socket boots 168 and plug boots 260 and the air compressed within the sealed space) provide a force that would drive the plug 200 apart from the connector 100, but for the pin 340 engaged in the slots 338. This upward force tends to keep the pin 340 within the detent 350 and prevents the handle 330 from rotating upward. Thus, providing an inner detent 350 at the point of where the plug 200 is fully inserted into the socket 100 requires additional force to be applied to the handle to remove the socket 100 from the plug 200, and otherwise retains the handle 330 at the fully inserted position.

With reference to FIGS. 14A-D, when removing the container 302 from the watercraft 300, the gripping portion 332 of the handle 330 is rotated upward. This causes the upper cam surface 348 of the slot 338 to engage the pin 340. The upper cam surface 348 applies a force to the pin 340 to force the socket 100 upward and away from the plug 200. The upper cam surface 348 of the slot 338 may be a smooth curved surface with no detents. This allows the handle 332 to be smoothly moved from the position where the plug 200 is fully inserted into the socket 100 to the position where the plug 200 is removed from the socket 100 with an approximately constant force. Once the pin 340 is no longer within the slot 338 of the handle 330, the handle 330 may be used to pull the end 322 of the container 302 upward and away from the plug 200. Once the plug 200 is fully removed from the socket 100, the container 302 may be pivoted, slid, and removed from the container, for example, as described in regard to the embodiment of FIG. 12A-D.

While the examples above illustrate a handle 330 being used to connect a container 302 to a watercraft 300, the handle 330 may be used to connect the socket 100 to the plug 200 in other applications as well. In other applications, the socket 100 is an electrical outlet in the wall of a boat into which the plug 200 of a power cord is inserted. In another application, the socket 100 and the plug 200 are each attached at the end of a power cord (e.g., like an extension cord and a power cord of a electrical device). The plug 200 may be inserted into the socket 100 to complete the connection through the power cords.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A watercraft comprising:

a flotation portion having a top surface, a bottom surface, a cavity for receiving a waterproof electronics container, and a projection extending above the cavity at one side of the cavity, such that the projection receives and affixes the waterproof electronics container within the cavity;

a strut having an upper end removably affixed to a portion of the watercraft, and the strut having a lower end extending away from the bottom surface of the flotation portion;

a propulsion unit disposed on the strut;

a first connector portion mounted to the upper end of the strut;

at least one latching pin disposed on the upper end of the strut;

the waterproof electronics container housing a power source;

a carrying handle pivotally coupled to the waterproof electronics container;

at least one arcuate slot formed in the carrying handle;

the waterproof electronics container being removably affixed to the upper end of the strut such that when the container is mechanically affixed to the strut, the container and the strut together clamp a portion of the flotation portion therebetween, the waterproof electronics container being mechanically coupled to the strut by engagement of the at least one latching pin with the at least one arcuate slot of the carrying handle;

a second connector portion disposed on the waterproof electronics container such that the second connector forms at least one electrically conductive pathway with the first connector portion when both are affixed to the watercraft.

2. The watercraft of claim 1 further comprising a hydrofoil removably attached at a lower end of the strut.

3. The watercraft of claim 1 wherein one or more of the at least one electrically conductive pathway carries electrical power to the propulsion unit.

4. The watercraft of claim 3 wherein one or more of the at least one electrically conductive pathway carries communication signals between a transceiver in the waterproof electronics container and a transceiver mounted in the propulsion unit.

5. The watercraft of claim 1 wherein at least one of the first connector and the second connector portion has replaceable conductor elements.

6. The watercraft of claim 5, the waterproof electronics container further comprising:

at least one seal encircling the second connector portion and disposed in an opening within the waterproof electronics container such that the second connector forms a portion of the waterproof electronics container;

wherein the waterproof electronics container remains waterproof during the process of replacing the replaceable conductor elements.

7. The watercraft of claim 1, the flotation portion further comprising:

at least one cavity disposed in the flotation portion, the at least one cavity configured to receive the waterproof electronics container;

wherein a surface of the waterproof electronics container is substantially coplanar with at least one outer surface of the flotation portion.

8. The watercraft of claim of claim 1, the first connector portion further comprising:

a base portion;

an insertion portion extending from the base portion for insertion into a cavity of the second connector, the insertion portion defining an interior cavity;

at least one pin including a first portion extending outwardly from the base portion into the interior cavity and a second portion extending into the base portion, the second portion of the at least one pin including a seal disposed therearound and extending between the second portion and the base portion; and at least one resilient sock disposed around the first portion of the at least one pin, the at least one resilient sock configured to contact a portion of the second connector upon insertion therein to electrically isolate the at least one pin from fluid present in the interior cavity of the insertion portion.

9. The watercraft of claim 8, the first connector portion further comprising at least one pin connector disposed within the base portion, the at least one pin connector including a first end for receiving at least a portion of the second portion of the at least one pin.

10. The watercraft of claim 9, the insertion portion of the first connector portion further comprising:

a substantially cylindrical exterior surface including a first cylindrical portion having a first diameter and a second cylindrical portion having a second diameter greater than the first diameter;

a first seal disposed around the first cylindrical portion; and a second seal disposed around the second cylindrical portion.

11. The watercraft of claim 9, the first connector portion further comprising a retaining member removably attached to a surface of the interior cavity, the retaining member including a hole for the first portion of the at least one pin to extend through, the retaining member affixing the at least one pin to the first connector portion.

12. The watercraft of claim of claim 1, the second connector portion further comprising:

a base portion;

a receptacle portion extending from the base portion and defining a cavity for receiving the first connector portion, wherein the first connector portion includes at least one pin;

at least one conductor permanently affixed to the base; and at least one pin connector removably affixed to the base and extending from the base into the cavity, the at least one pin connector including a first end having a socket configured to receive the at least one pin of the first connector and a second end affixed to the at least one conductor, wherein when the first connector portion is received within the cavity of the receptacle portion, the at least one conductor forms an electrical pathway with the at least one pin of the first connector portion via the at least one pin connector.

13. The watercraft of claim 12, the second connector portion further comprising a resilient seal between the at least one conductor and the base portion.

14. The watercraft of claim 12, the second connector portion further comprising:

a retainer having at least one passage therethrough;

wherein the retainer is removably affixed to the base portion such that the retainer secures the at least one pin connector to the base portion and at least a portion of the first end of the at least one pin connector extends into the at least one passage.

15. The watercraft of claim 12, the second connector portion further comprising:

a substantially cylindrical internal surface defining the cavity within the receptacle portion, the internal surface including a first cylindrical portion deepest within the cavity and having a first diameter, and the internal surface further including a second cylindrical portion closest to an open end of the cavity and having a second diameter greater diameter than the first diameter;

wherein the first cylindrical portion is configured to mate with a first resilient seal of the first connector portion; and wherein the second cylindrical portion is configured to mate with a second resilient seal of the first connector portion.

* * * * *